US005966753A

United States Patent [19]

Gauthier et al.

[11] Patent Number: 5,966,753

[45] Date of Patent: Oct. 19, 1999

[54] METHOD AND APPARATUS FOR PROPERLY SEQUENCED HAND WASHING

[75] Inventors: Jerome M. Gauthier, Roselle; Nhon T. Vuong, Lombard; Mark J. Sippel, Schaumburg, all of Ill.

[73] Assignee: Sloan Valve Company, Franklin Park, Ill.

[21] Appl. No.: 09/001,736

[22] Filed: Dec. 31, 1997

[51] Int. Cl.[6] ..... E03C 1/05

[52] U.S. Cl. ..... 4/623; 4/624; 4/628

[58] Field of Search ..... 4/623, 619, 624, 4/628

[56] References Cited

U.S. PATENT DOCUMENTS

| | | | |
|---|---|---|---|
| 3,576,277 | 4/1971 | Blackman . | |
| 3,639,920 | 2/1972 | Griffin et al. . | |
| 4,398,310 | 8/1983 | Lienhard . | |
| 4,606,085 | 8/1986 | Davies . | |
| 4,942,631 | 7/1990 | Rosa . | |
| 4,989,755 | 2/1991 | Shiau . | |
| 5,031,258 | 7/1991 | Shaw . | |
| 5,060,323 | 10/1991 | Shaw . | |
| 5,199,118 | 4/1993 | Cole et al. . | |
| 5,202,666 | 4/1993 | Knippscheer . | |
| 5,217,035 | 6/1993 | Van Marcke . | |
| 5,781,942 | 7/1998 | Allen et al. | 4/623 |

FOREIGN PATENT DOCUMENTS

| | | | |
|---|---|---|---|
| 3938533 | 5/1991 | Germany | 4/623 |
| 3-125731 | 5/1991 | Japan | 4/623 |
| 4-216728 | 8/1992 | Japan | 4/623 |

*Primary Examiner*—Steven O. Douglas
*Assistant Examiner*—Tuan Nguyen
*Attorney, Agent, or Firm*—Dorn, McEachran, Jambor & Keating

[57] ABSTRACT

An apparatus and method for controlling plumbing fixtures includes an electronic control board having a microprocessor that accepts four inputs and produces four outputs. Inputs at other than the microprocessor's operating voltage are converted thereto. Outputs having different voltages are controlled by latching relays. The control board can be used with a sink that requires a sequenced hand washing. The control board can form a node on a network that monitors and controls the functions of multiple boards throughout a facility.

20 Claims, 21 Drawing Sheets

VCC
VCC
C15
R13
U3
DU
VPP
A12
A7
A6
A5
A4
A3
A2
A1
A0
NC
O0
O1
O2
GND
A14
A13
A8
A9
A11
NC
IOE
A10
ICE
O7
O6
O5
O4
O3
DU
U12
A0
A1
A2
A3
A4
A5
A6
A7
A8
A9
A10
A11
A12
A13
A14
NC
NC
A15
IE
R/1W
VDD
D0
D1
VDD
VDD
VSS
D2
D3
D4
D5
D6
D7
VCC
C27
VCC
VCC
R20
U4A
VCC
U8B
C8
C17
E
R/1W
U8C
10
24

A
SET PROGRAM TO REFLECT USER RIGHTS
220
A1
222
MAIN TABLE VIEW (ROOMS WITH NAME)
FILE
224
YES
B
NO
NETWORK
226
YES
C
NO
REPORT
228
YES
D
NO
OPTIONS
230
YES
E
NO
HELP
232
YES
F
NO
ENABLE ALL WATER
234
YES
G
NO
DISABLE ALL WATER
236
YES
H
NO
TABLE VIEW FILTER
238
YES
I
NO
NEW VIOLATION
240
YES
J
NO
ENTER A ROOM
242
YES
K
NO

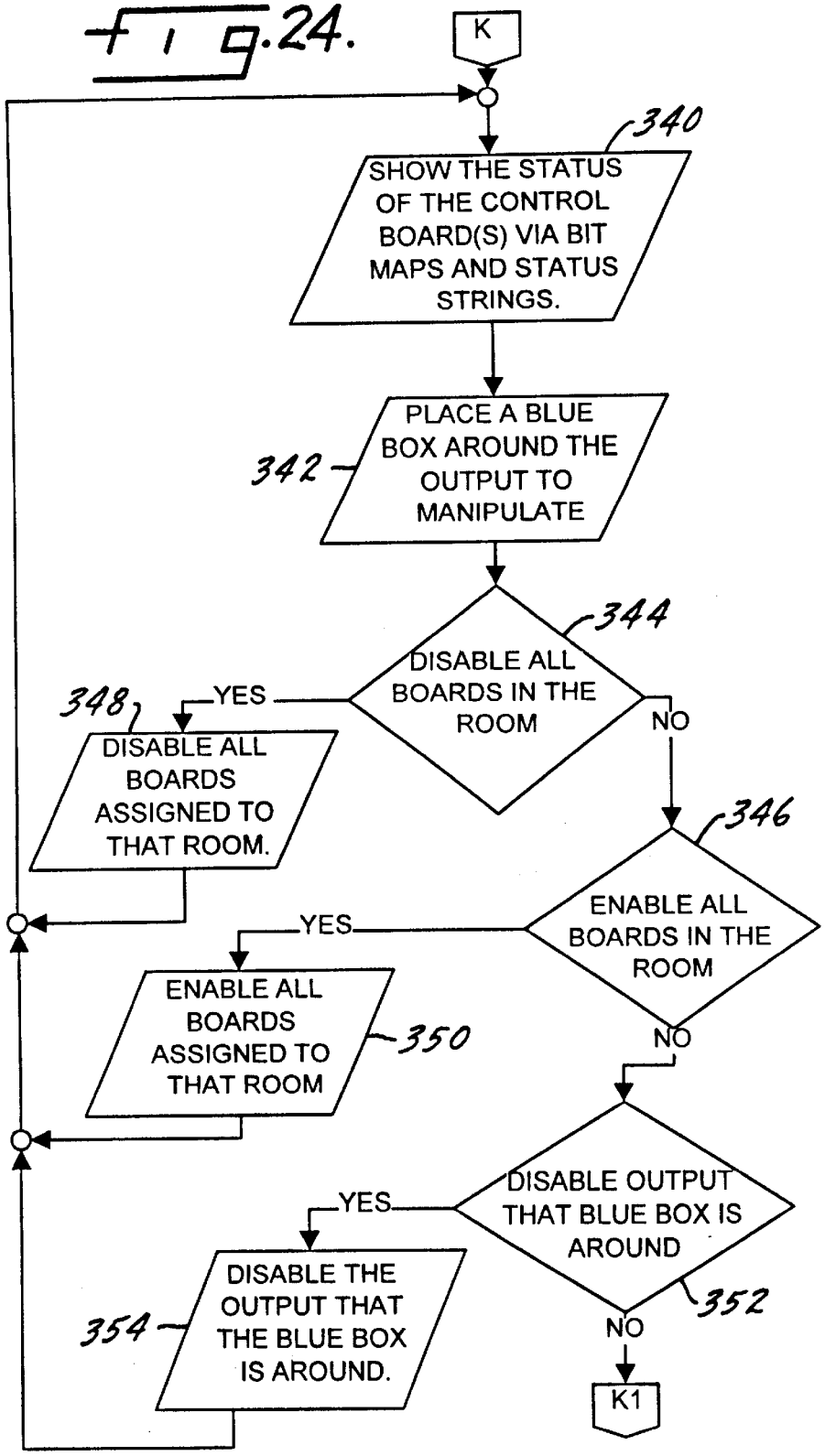
Fig. 24.
K
340
SHOW THE STATUS OF THE CONTROL BOARD(S) VIA BIT MAPS AND STATUS STRINGS.
342
PLACE A BLUE BOX AROUND THE OUTPUT TO MANIPULATE
344
DISABLE ALL BOARDS IN THE ROOM
YES
NO
348
DISABLE ALL BOARDS ASSIGNED TO THAT ROOM.
346
ENABLE ALL BOARDS IN THE ROOM
YES
NO
ENABLE ALL BOARDS ASSIGNED TO THAT ROOM
350
DISABLE OUTPUT THAT BLUE BOX IS AROUND
YES
NO
352
354
DISABLE THE OUTPUT THAT THE BLUE BOX IS AROUND.
K1

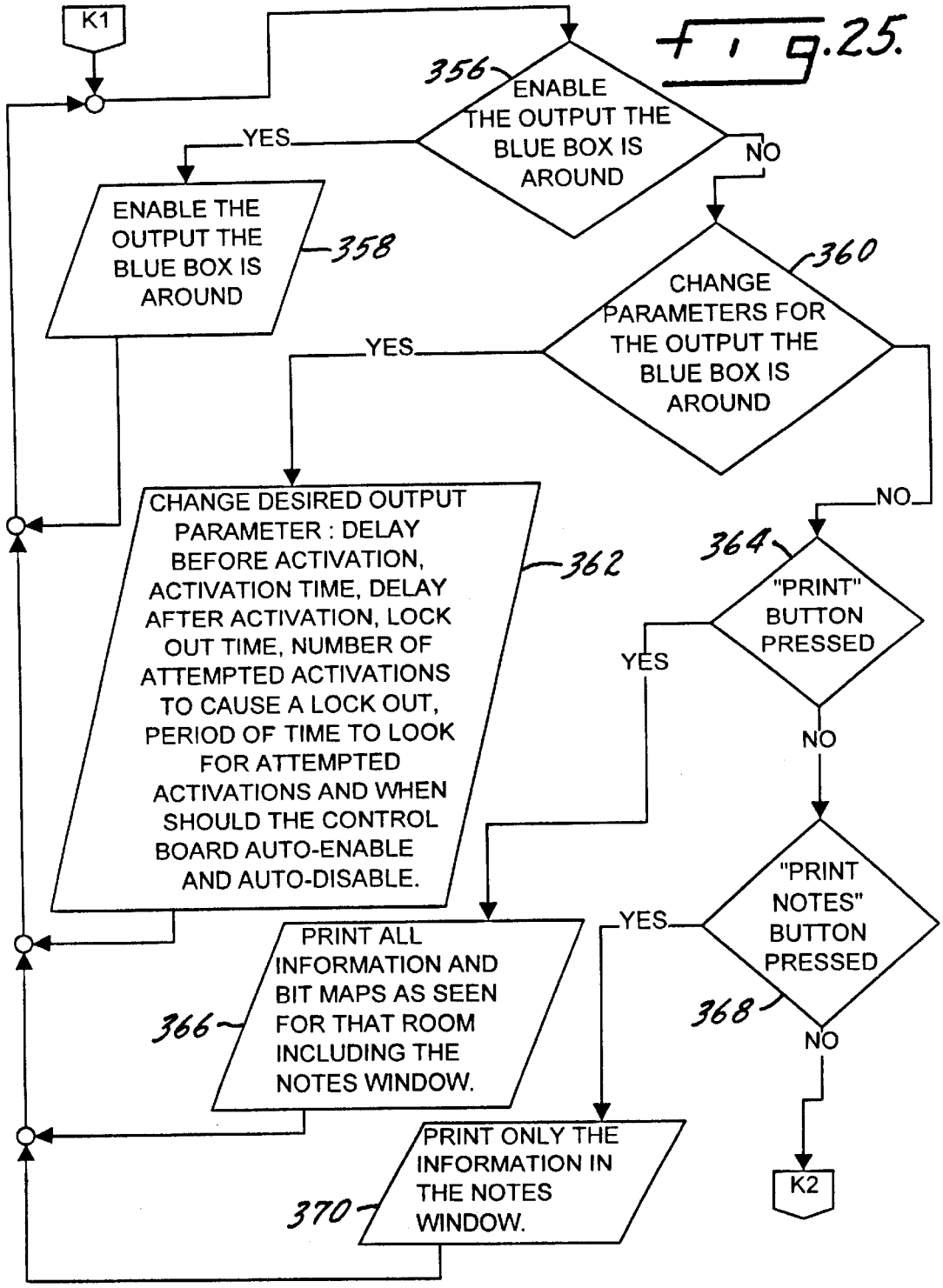
K1
Fig.25.
356
ENABLE THE OUTPUT THE BLUE BOX IS AROUND
YES
NO
ENABLE THE OUTPUT THE BLUE BOX IS AROUND
358
360
CHANGE PARAMETERS FOR THE OUTPUT THE BLUE BOX IS AROUND
YES
NO
CHANGE DESIRED OUTPUT PARAMETER : DELAY BEFORE ACTIVATION, ACTIVATION TIME, DELAY AFTER ACTIVATION, LOCK OUT TIME, NUMBER OF ATTEMPTED ACTIVATIONS TO CAUSE A LOCK OUT, PERIOD OF TIME TO LOOK FOR ATTEMPTED ACTIVATIONS AND WHEN SHOULD THE CONTROL BOARD AUTO-ENABLE AND AUTO-DISABLE.
362
364
"PRINT" BUTTON PRESSED
YES
NO
"PRINT NOTES" BUTTON PRESSED
YES
368
NO
PRINT ALL INFORMATION AND BIT MAPS AS SEEN FOR THAT ROOM INCLUDING THE NOTES WINDOW.
366
PRINT ONLY THE INFORMATION IN THE NOTES WINDOW.
370
K2

Fig. 27.
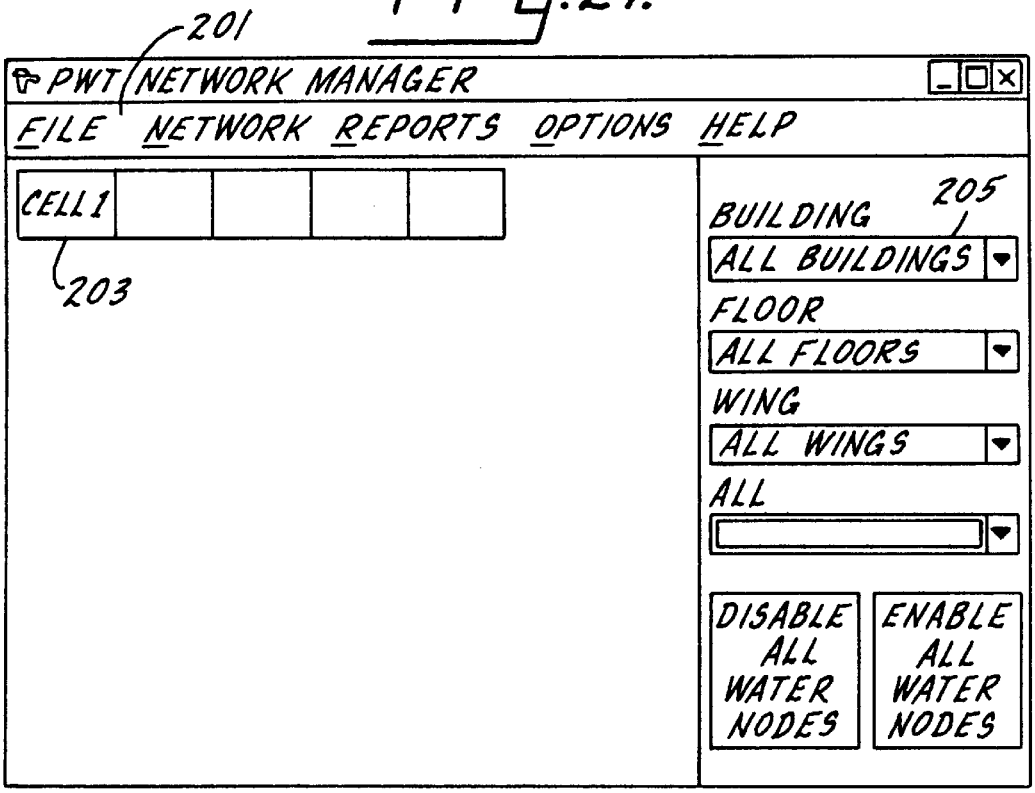
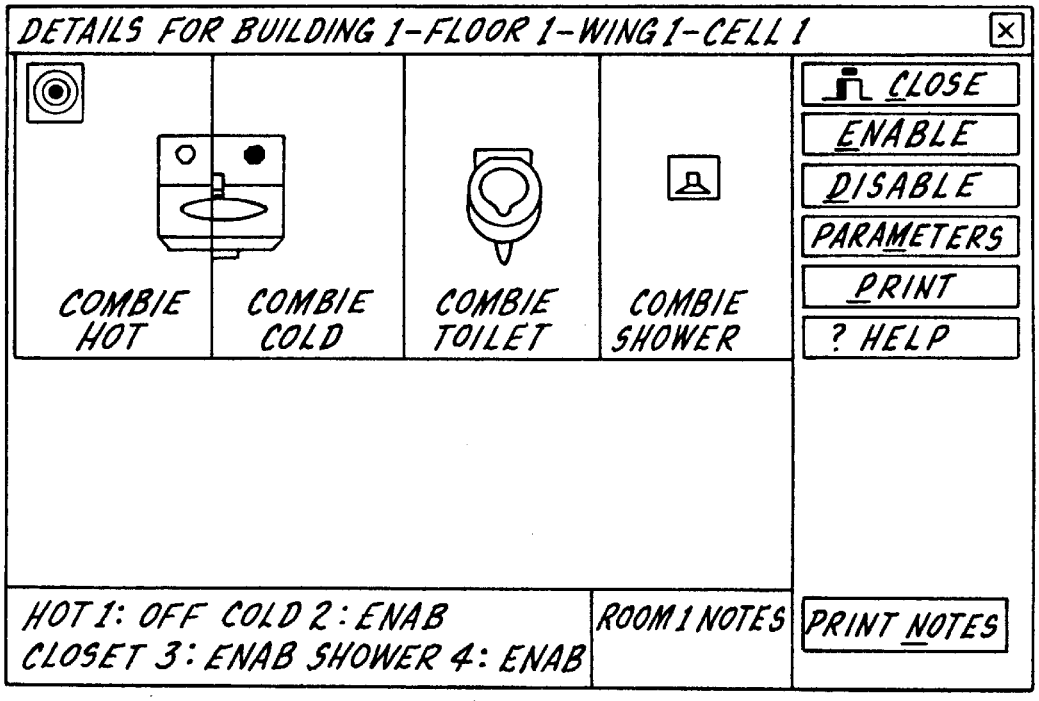
Fig. 28.

METHOD AND APPARATUS FOR PROPERLY SEQUENCED HAND WASHING

BACKGROUND OF THE INVENTION

This invention relates to an apparatus and method for monitoring and controlling usage of water. Various electrical controls for plumbing fixtures are known in the art. Some examples are shown in U.S. Pat. No. 5,060,323 and U.S. Pat. No. 5,031,258. These controls typically employ water valves operated electrically by solenoids, together with various types of switches for activating the solenoids at desired times. The switches include pushbutton switches, infrared sensors in reflective mode or break-beam mode for determining when a user is present and when water should be supplied.

One of the problems with prior art controls is their inherent lack of flexibility. The controls can only perform one function with one type of fixture. Yet there is a wide variety of plumbing fixtures that need to be controlled, such as sinks (with temperature controlled either by pre-set hot and cold water mixing or user-selectable mixing), showers, urinals and water closets. It is also sometimes desirable to control related apparatus such as soap dispensers and towel dispensers. Existing controls cannot be used with all of these different facilities, at least not without substantial alteration of their basic functions to the point of totally rebuilding the controls to suit a different device. Further complications arise due to the fact that some controlled devices (sinks, showers, soap dispensers) need to respond to the arrival or presence of a user, while other devices (urinals, water closets) need to be aware of the presence of a user but not operate until the user leaves a target zone. Prior art controls are simply not set up to operate multiple types of fixtures in the various modes needed.

In many institutional settings it would also be desirable to allow the operator of the facility to select particular operating characteristics of an apparatus. For example, in dormitories and barracks it might be useful to limit the length of time a shower will operate. Correctional institutions may want to limit the number of times a water closet may be flushed within a given time window. Health care or food service operations may prefer a hand washing apparatus which will assure proper hand washing procedure by the restaurant employees or hospital personnel in order to reduce the chance of contamination. Being able to choose these limits would be highly useful in these settings and others but the lack of flexibility in existing controls prevents it.

Another desirable feature of water usage controls is the ability to monitor remotely what is going on at a particular fixture or at all fixtures throughout a building or institution. A further desirable feature would be to alter remotely how a particular fixture operates. This requires communications capabilities that are not found in existing controls.

SUMMARY OF THE INVENTION

The present invention is directed to a control board for plumbing fixtures that can be used with a wide variety of fixtures. The board has a microprocessor which is programmable from either a stored program or downloaded instructions or a combination of these. The microprocessor operates in any desired mode with settings that are either predetermined or set individually as desired. The settings establish a timing control for the controlled device, be it a sink, shower, water closet or some combination of these. The timing control includes a delay before activation, a run time, a delay after activation, the counting of cycles within a selected time window, and an imposed lockout or inhibit time if a cycle count limit is exceeded.

The control board can operate either as a stand alone device or in a computer network, in which case the board communicates via either twisted pair or a power line with a central computer for monitoring and control purposes. The board can control solenoid valves or the like either directly or through auxiliary boards. Input jacks on the control board can accept signals ranging from 1.3 VAC to 120 VAC and 1.3 VDC to 100 VDC. An opto-isolator can be used, if necessary, to convert input voltages other than the one used by the microprocessor. The output section of the board uses latching relays to conserve power. Three different outputs can be provided, depending on the needs of the controlled device. These outputs include two different on-board voltages or an off-board voltage. A switch closure can also be provided to govern operation of a self-powered controlled device.

BRIEF DESCRIPTION OF THE DRAWINGS

FIG. 1 is the power supply section of the board.

FIG. 2 shows representative samples of the input and output sections, only one of each being shown for clarity.

FIG. 3 shows the microprocessor and some auxiliary functions and the output addressing chip. The circuits in FIGS. 2 and 3 are joined at junctions V, W, X, Y and Z.

FIG. 4 shows the microprocessor, the EPROM and a portion of the flash option.

FIG. 5 shows the off-board voltage connector and one of the jumpers for selecting outputs.

FIG. 6 shows the PLT-21 communications option.

FIG. 7 shows the FTT-10A communications option.

FIGS. 13 through 26 comprise a flowchart of the Programmed Water Technologies network software.

FIG. 27 is the main menu screen of the network software.

FIG. 28 is the detail form of the network software showing the devices in a particular room.

DETAILED DESCRIPTION OF THE INVENTION

The present invention encompasses a new control board that can be used with plumbing fixtures such as sinks, showers, water closets, urinals and combinations of these. The board can provide the central control of a programmed scrub sink referred to herein as a Smart Sink. The board can also provide network communications with a central computer for monitoring and data logging plumbing fixtures throughout a facility in a system referred to as Programmed Water Technologies. The present description will deal with these three major areas: the 4IO board, the Smart Sink and its software, and the Programmed Water Technologies network software.

I. The 4IO Board

A schematic diagram of the control board 10 of the present invention is shown in FIGS. 1–7. This particular embodiment can accept input from four sensors or switches and direct output to four controlled devices. Due to this capability of handling four inputs and outputs, it is referred to herein as a 4IO board. It will be understood that different numbers of inputs and outputs could be used within the scope of the present invention. A description of the major components of the 4IO board follows.

A. Power Supply Section

Figure 1:
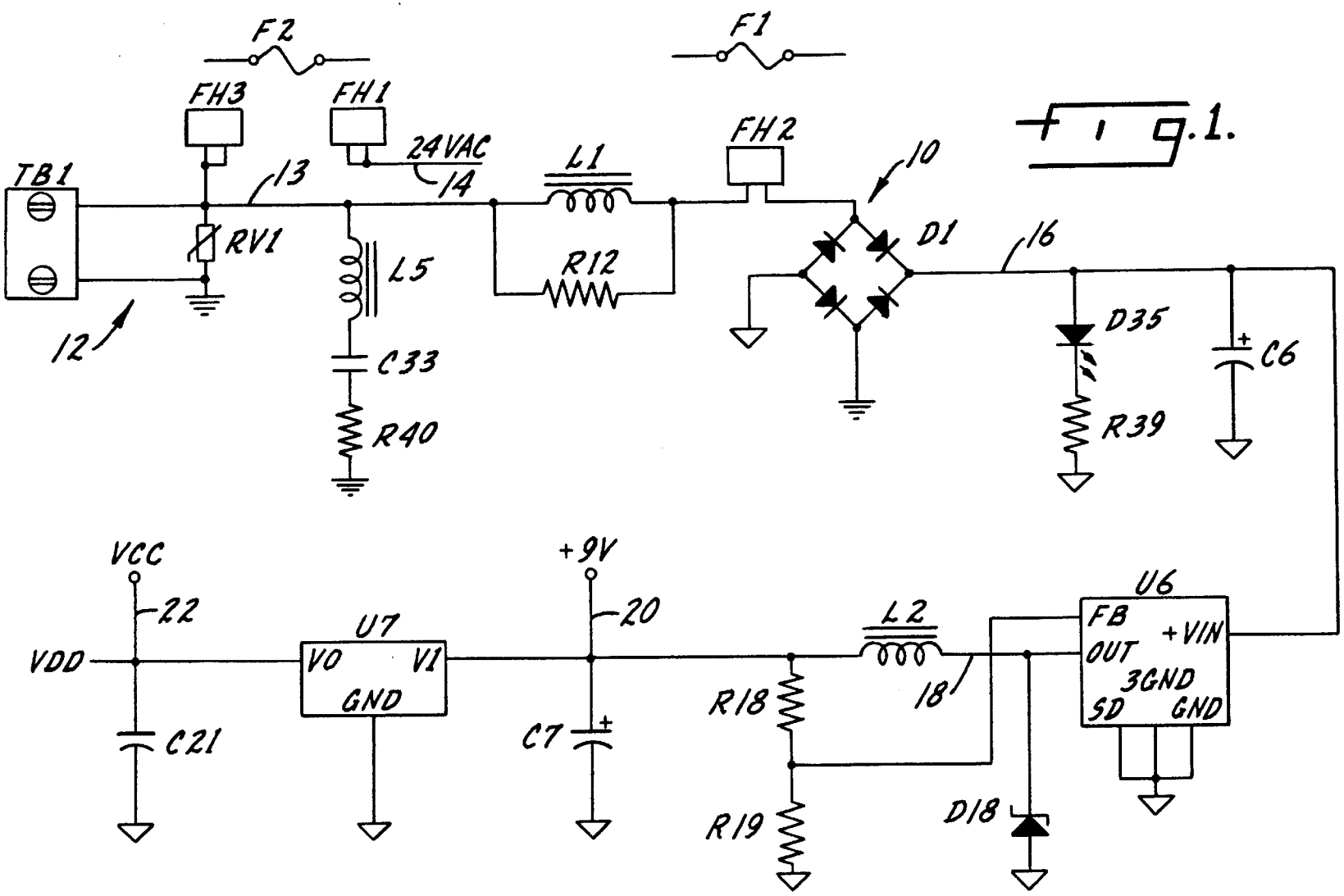
FIGS. 1–7 together comprise a circuit diagram of the 4IO board. More specifically

The power supply section of the board is shown generally at 12 in FIG. 1. An off-board transformer (not shown) will provide 24 VAC to connector TB1. The transformer is somewhere upstream outside of the 4IO board. Typically it is connected to the 120 VAC power main of the building. It could be a transformer that is supplying power to one board or it could be a transformer supplying power to many boards. Line 13 from TB1 is connected to one side FH3 of a fuse holder. The other side FH1 of the fuse holder is connected to output power line 14, which is marked 24 VAC. This output power line 14 is connected to any other location on the circuit diagram similarly marked 24 VAC. The fuse F2 in holder FH1, FH3 is a slow blow, two-amp fuse that limits the power output on line 14.

Line 13 has filters indicated at inductor L5, capacitor C33 and resistor R40, and inductor L1 and resistor R12. Then there is another fuse F1 in microfuse holder FH2 to protect the 5-volt logic circuit. Fuse F1 is a quick-blow fuse rated at two amps. The 24 VAC goes through the second fuse F1 to a bridge rectifier D1 which turns the 24 VAC into approximately 30 VDC on line 16. An LED D35 indicates the presence of the 30 VDC. A capacitor C6 charges up to maintain a stable input. That is used as a reserve so if there is a small brownout, or if the line 16 goes down, there is a small reserve of power. The board can survive off this reserve for a short period of time.

Line 16 feeds the 30 VDC to a 9-volt switcher U6 which allows voltage up to 9 volts DC to go through to line 18. When voltage to line 18 starts to exceed 9 VDC the switcher turns off. When the voltage falls back below 9 volts the switcher turns back on. So the switcher produces a pulsating 9 volts DC on line 18. A filter comprising inductor L2 and resistors R18, R19 conditions the voltage. The purpose of the 9-volt switcher U6 is to reduce the voltage going through to a 5-volt regulator U7. If the circuit went directly from 24 VAC through the bridge rectifier to the 5-volt regulator, the 5-volt regulator would over-heat. Since the 9-volt switcher is required anyway, that 9 volt power is supplied on output line 20. Other locations on the circuit marked +9V are connected to line 20. Among other things the 9 VDC is used to activate the latching relays in the output section, as will be explained below. A latching relay only needs a 10 millisecond pulse to latch or unlatch. The switcher U6 is going to be on most of the time so usually when the 9 VDC is needed it will be there. There is also a capacitor C7 connected to line 18 to store up some power. In the event that the switcher U6 happens to be off when relay activation is called for, capacitor C7 will be able to supply the short pulse needed to latch the relay.

The 9 VDC is supplied to the 5-volt regulator U7. The 5-volt regulator takes the 9 VDC and drops it down to 5 VDC, which is the operating voltage for the microprocessor and the rest of the logic circuit. The 5 VDC is supplied on output line 22. Locations on the circuit marked VCC are connected to line 22. Capacitor C21 is a high pass filter.

Taken together the power section is capable of supplying 24 VAC on line 14, 9 VDC on line 20 and 5 VDC on line 22.

B. Microprocessor

Figure 3:
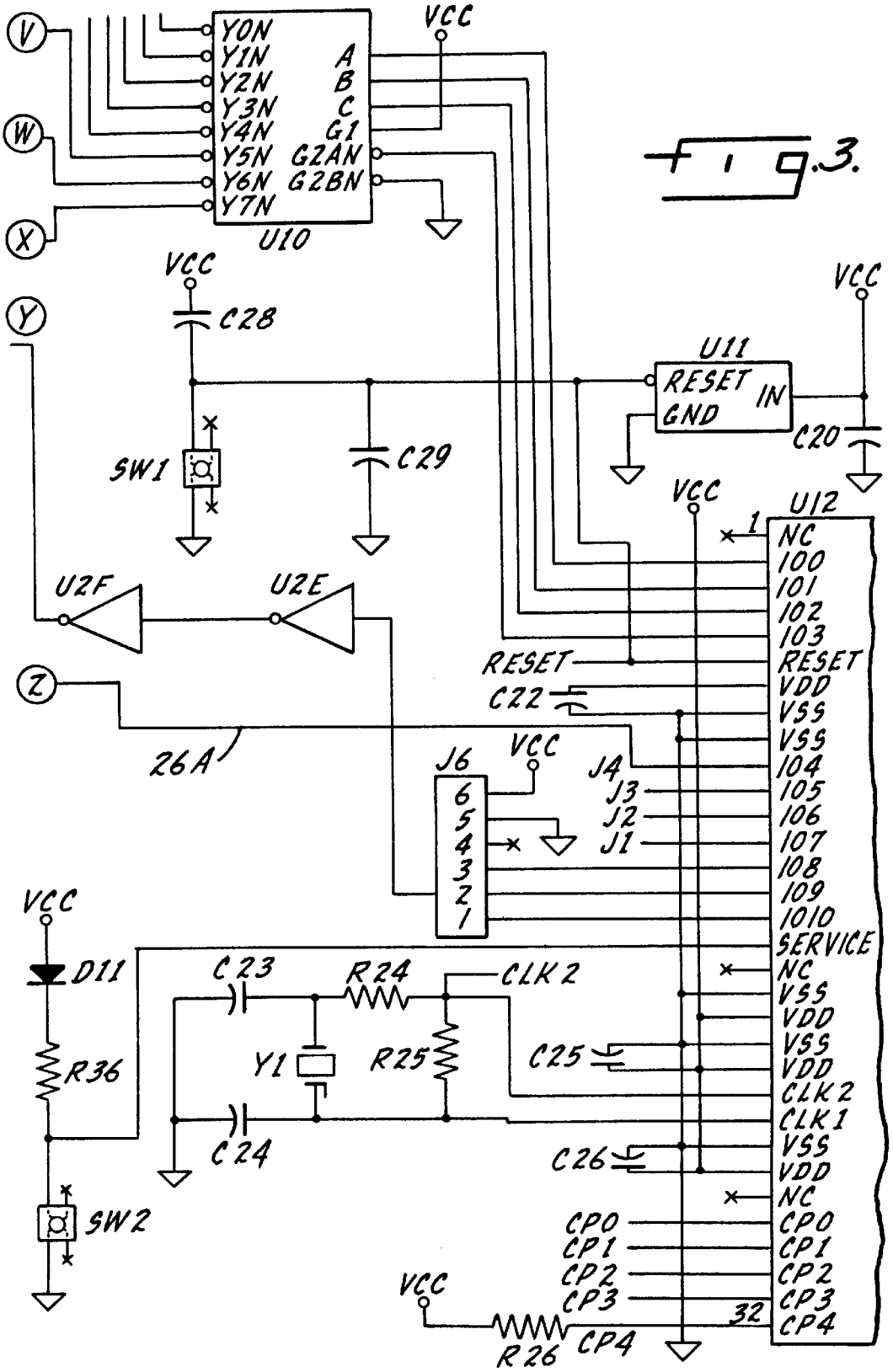
Figure 4:
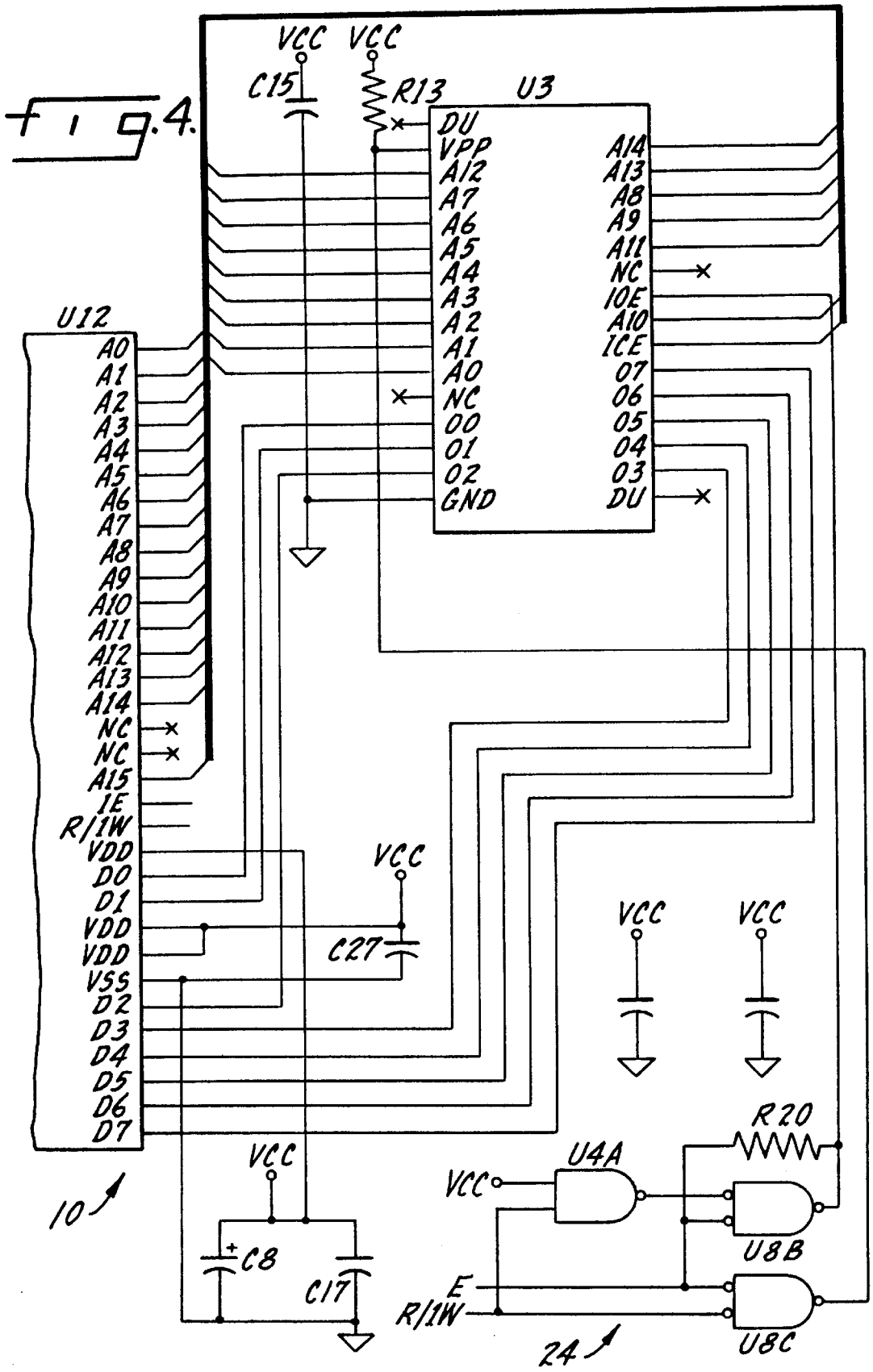

The functions of the 4IO board are controlled by a microprocessor U12 (FIGS. 3 and 4). The microprocessor is preferably a neuron type 3150, such as a TMP N3150 B1AF from Echelon Corporation of Palo Alto, Calif., although others may suffice. It is designed to run at a specified operating voltage, in this case 5 VDC. The microprocessor has an internal electrically erasable, reprogrammable memory that will be referred to herein as the EE section of the microprocessor. The EE section is non-volatile memory, meaning that the information in the EE section will not be lost even if the power goes out. The microprocessor has three internal processors. One of these runs the 4IO software described below. Another runs communications software that is provided with the chip. The third processor runs software that translates information between the first two processors.

The first processor runs a 4IO program stored in an EPROM U3 (FIG. 4). The program is burned it into the chip and therefore is fixed. The EPROM communicates with the microprocessor through lines A0 to A15 and D0 to D7.

The 4IO board has heads or connectors built into it to provide a stuffing option that allows for an alternate embodiment called a flash option. The stuffing option can receive the logic chips shown generally at 24. When these chips are provided the regular EPROM U3 is replaced with a flash EPROM, also known as an EEPROM (for electrically erasable programmable read only memory). When a flash EPROM is used an operator can download new software and store it in the flash EPROM. Thus, the entire program can be rewritten. With the regular EPROM changing the software requires putting in a new EPROM chip. The details of the 4IO software will be discussed below.

It will be noted that several clean-up capacitors are used to clean up the 5 volts that is being distributed throughout the chips. Capacitors C8 and C17 (FIG. 4) form a high pass and a low pass filter. Capacitors C15, C22, C26, C25, C27 serve as high pass filters. In the event that the power drain upstream limits the voltage, capacitor C8 will also serve as a small battery for the 5 VDC source.

C. Input Section

A description of the input section details will benefit from a preliminary discussion of the various remote switches and sensors that might be found on a controlled device, i.e., on a sink, shower or water closet.

Figure 8:
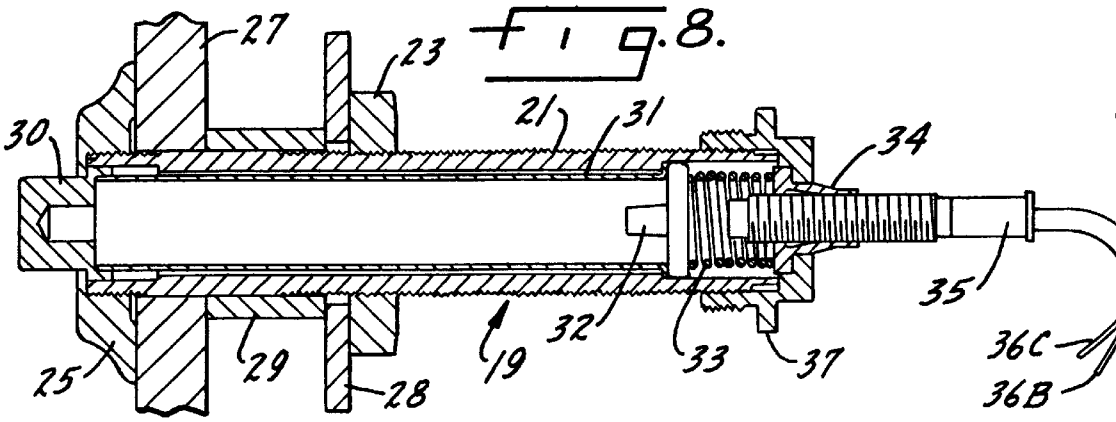
FIG. 8 is a longitudinal section of a pushbutton switch used to actuate a plumbing fixture.

A commonly-used switch is an inductive pushbutton switch, as shown at 19 in FIG. 8. The switch 19 has a cylindrical housing 21 which has external threads for engaging a mounting nut 23 and a wall flange 25. The housing is clamped to an appropriate fixed mounting surface 27 by the nut 23 and wall flange 25. Typically the mounting surface 27 will be a wall near the sink, water closet or shower or it might be a part of the fixture itself. A washer 28 and spacer 29 assist the clamping action. The wall flange 25 retains a pushbutton 30 which is slidable through a central opening in flange 25. The pushbutton abuts one end of a flanged filler tube 31. The other end of tube 31 adjoins a T-shaped plunger 32, which is made of ferrous metal. The plunger 32, filler tube 31 and pushbutton 30 are all biased to the left of FIG. 8 by a spring 33. Spring 33 bears against a packing 34 which is retained by a bushing 37. The bushing is threaded to the housing 21. A proximity sensor 35 is mounted in the packing 34. Three conductors 36A,B,C supplying 5 volts DC, a return signal and a ground, respectively, are attached to the proximity sensor 35 and run back to the 4IO board. When a user of the controlled device pushes the pushbutton 30 it carries the plunger 32 close to the sensor 35 and changes the magnetic field adjacent the sensor. The altered magnetic field triggers a circuit inside the sensor 35 which closes a circuit between lines 36A and 36B, thereby creating a 5

VDC return signal. The sensor is a readily available item and itself forms no part of the present invention.

It will be understood that while the pushbutton switch is commonly used to indicate to the 4IO board a user's request for operation of a plumbing fixture, other types of devices can also be used. For example, infrared light sensors can be used to detect the presence of a user. An infrared emitter and detector can be placed adjacent one another and infrared light reflected back from, say, a user's hands under a faucet, will trigger the detector. Or the emitter and detector can be separated with the emitter focused on the detector. When a user breaks the light beam between the emitter and detector a signal is triggered. When greater distances between the 4IO board and a switch are required, a reed switch and a 24 VAC supply and signal may used, rather than the 5 VDC. Or a relay switch may be used with 5 volts going in with the return line coming back. In that case, instead of just a piece of ferrous metal in the housing, there is a magnet. When the magnet comes close to the relay switch, the relay switch makes a contact which then gives a 5 volt return signal.

Other inputs to the microprocessor may involve monitoring the activities of various components, rather than looking for remote switch closures. For example, it may be desired to monitor a 16 VDC motor or a 24 VAC solenoid to find out when they activate so some action can be taken in response thereto.

The foregoing illustrates that the 4IO board must have the ability to accept a wide variety of input signals. The input section that provides that ability will now be described. The 4IO board communicates with the various switches or sensors of a controlled device through four RJ-11 style input jacks, one of which is shown at J4 in FIG. 2. Jack J4 is connected by jumpers JP9 and JP10 to an inverting Schmitt trigger U2A, either directly or through an opto-isolator U1A. The Schmitt trigger is connected to an I/O port of the microprocessor by line 26A as shown. The jumpers may have shunt clips that simply connect selected pairs of pins to one another.

Pin 1 of J4 is connected to the 24 VAC source as shown. If the particular remote switch or sensor connected to J4 requires 24 VAC, pin 1 of J4 supplies it. Naturally if the switch does not use 24 VAC (or has its own power supply), the cable plugged into jack J4 would not have a connection to pin 1.

Similarly, pin 2 of J4 is connected to the 5 VDC source as shown. In the case of the pushbutton switch, conductor 36A will connect to pin 2, providing the 5 VDC source to the pushbutton switch. If the remote switch does not need 5 VDC, the cable plugged into jack J4 would not have a connection to pin 2.

Pin 3 of J4 is a first sensor return. In the case of the pushbutton switch, pin 3 will connect to conductor 36B, providing the 5 VDC return signal. Line 39 connects pin 3 of J4 to pin 2 of jumper JP10.

Pin 4 of J4 is connected to a clock signal from IO9 of the microprocessor. In a pushbutton scenario, a clock signal is not used. But there may be some type of remote sensor that either requires a clocking pulse to tell it when to operate or while it is operating it may need clock pulses. Pin 4 would provide those pulses.

Pin 5 of J4 is a DC ground. In the case of the push-button switch, pin 5 will connect to conductor 36C.

Pin 6 of J4 is a second sensor return signal. Again, in the case of a push-button switch, the 5 volt return signal would come in pin 3 and pin 6 would not be used. Pin 6 would be used with an AC return signal. Line 41 connects pin 6 to jumper JP9's pin 2.

The shunt clips of jumpers JP9 and JP10 are set in accordance with the type of remote switch or device connected to jack J4. If the remote switch connected to J4 provides a 5 VDC return on pin 3 of J4, the pins 1 and 2 of JP10 are shorted, as are pins 1 and 2 of JP9. In that case the return signal on pin 3 of J4 goes directly to the input of Schmitt trigger U2A, bypassing the opto-isolator U1A. Also, in the case of a 5 VDC return signal the opto-isolator input pin K,A is grounded through JP9 pins 2 and 1. The reason why this is done is if one side of the opto-isolator is left open it can pick up some noise because it has the ability to look at alternating current and it takes very little power to trigger it. JP9 forcibly ties it down so it will not operate. In the meantime input A,K of the opto-isolator U1A is just floating freely. So nothing is going into the opto-isolator. Therefore, nothing is going to come out and mess up the signal that is coming around it from JP10.

If the remote switch connected to J4 provides a return on pin 3 of J4 that is anything other than 5 VDC, the pins 2 and 3 of jumper JP10 are shorted, sending the return signal to input A,K of the opto-isolator U1A. The settings of jumper JP9 depend on the power source for the remote switch or device. If the remote device has its own power supply then the shunt clip is left entirely off of jumper JP9. If the remote device uses the 5 VDC power from J4 pin 2, then jumper JP9 is set to pins 1 and 2 to provide a DC ground. If the remote device uses the 24 VAC power from J4 pin 1, then jumper JP9 is set to pins 2 and 3 to provide an AC neutral through line 43.

When the opto-isolator receives an input on its ports A,K and K,A, it sends an infrared signal inside the device. The infrared signal closes an electrical connection between ports C and E. Because an infrared light signal is used internally in the opto-isolator to trigger the output, there is no physical electrical connection between the input side (ports A,K & K,A) and the output side (ports C & E). Thus, whatever pin C is hooked up to will be sent as an output signal, regardless of what input triggered the output. In the present invention port C is hooked up to 5 VDC. So now, no matter what signal arrives on the input side of U1A, the rest of the circuit sees it as a 5 VDC signal on line 38.

The opto-isolator would be used when the 4IO board is looking at a voltage other than 5 VDC or if it looking at a voltage not supplied from the board. For example, take the case of monitoring a solenoid which operates at 24 VAC. Jumper JP10 is set to pins 2 and 3 and the other jumper JP9 is set at pins 2 and 3 so that same signal can be returned. Thus, the board is monitoring what is on J4 pin 3 but not giving it any power. With this arrangement there is no concern about having a common ground or common power supply; the board is just tapping in to see what is happening with that particular solenoid. When it activates or deactivates then the signal can be modified, whatever it is, to a 5 VDC signal and the processor runs off of this new signal. And then, of course, in software this signal can be controlled to be on or off, or when it should activate depending on when that signal comes in, or if it should activate when the signal comes in.

Now there is a 5 VDC signal on line 38 going into the Schmitt trigger U2A, whether that signal comes from the opto-isolator or through jumper JP10. Because the opto-isolator is picking up AC, it has the ability to generate AC noise on the line. To clean up the 5 volt signal as much as possible there is a filter C4, R10 to help reduce that high frequency noise. The filtered 5 volt signal is sent to the Schmitt trigger U2A which is part of the common circuit.

As in most electronic logic circuits, the 4IO board uses inverted logic. That is, the normal output state is a logic high. In electronics when a line breaks, there is nothing there. Logically that is considered a high by solid state electronics and a microprocessor. Because in the rest of the line, there is always a little bit of trickle back from the components, it will drive a line high. To have a good, definite signal you really want the line to drive low. With a low line it is known that a signal is definitely there; there is no question about whether some voltage is a signal or noise. Accordingly, the Schmitt trigger U2A is an inverter. What the Schmitt trigger does is take a signal coming in that is variable due to noise and capacitance in the line and when the input signal reaches a certain point, the Schmitt trigger turns on and produces a clean signal out in the form of a square wave. In this case, U2A is an inverting Schmitt trigger so, when the input signal goes high the output is a nice, square wave with logic low. Whatever signal comes in the Schmitt trigger cleans it up and produces the opposite on line 26A for the microprocessor.

Amplifier U5C is involved with driving LED D5. The LED cannot be driven with the same signal sent to the microprocessor, because doing so can draw too much power away and produce a very weird signal. In this case, a low signal is used to indicate that something was occurring. It is desired that the LED D5 turn on to indicate the presence of a signal. Thus, the LED is working in reverse of the logic used by the microprocessor. An amplifier U5C is used to increase the power enough to drive the LED D5 so it turns on when a logic line goes low.

Power for LED D5 is derived from VCC as shown. When line 38 goes high (indicating the presence of a signal), line 40 goes low. Amplifier U5C drives line 42 low. The amplifier U5C just takes whatever signal is on line 40 and gives more power to it. So, in this case, the amplifier is amplifying a logic low so it is forcing line 42 low. The power VCC is coming through the LED D5 and a current limiting resistor R17 to try to bring this line 42 up. But U5C wants to make it low so now you have an electronic battle which will be won by U5C which can sink more than what resistor R17 can supply because it is a current limiting resistor. So there is a current path that flows to the ground of U5C and this turns the LED D5 on.

When line 38 is low (indicating the absence of a return signal), line 40 is high. Then amplifier U5C forces line 42 high. Now there is a high voltage on both sides of LED D5, there is no current path and LED D5 is off.

It will be understood that for clarity only one input jack J4 is shown and described. In actuality the board has a plurality of input jacks identical to J4. In the preferred case there are four, although it could be a different number. Each input jack has the same associated circuit elements as shown for jack J1, i.e., a pair of jumpers, an opto-isolator, a Schmitt trigger, an LED driver and associated components. Thus, input lines labeled J1, J2, J3 in FIG. 3 each connect to the same circuit as shown for input line 26A.

D. Output Section

The output section of the 4IO board faces the same general problem of the input section, namely, a variety of different controlled devices need to be accommodated. A common controlled device will be a solenoid for actuating a water valve on a sink or shower. But the controlled device might also be a solenoid-activated flush valve, a motor for a soap or towel dispenser, or an auxiliary control board for one of these. Different outputs are required for these different devices so provision must be made for supplying and controlling these outputs.

As in the case of the input section, the 4IO board has four RJ-11 style jacks for connection to the controlled devices. One of these jacks is shown at J10, the others being similar. Briefly, pin 1 of each output jack connects to a switched 5 VDC. Pin 2 is connectable to an selectable power source. Pin 3 provides a switched selectable power source. Pin 4 is not used. Pin 5 is the return for the selectable power. Pin 6 is a DC ground. How these connections are made will now be described.

Figure 9:
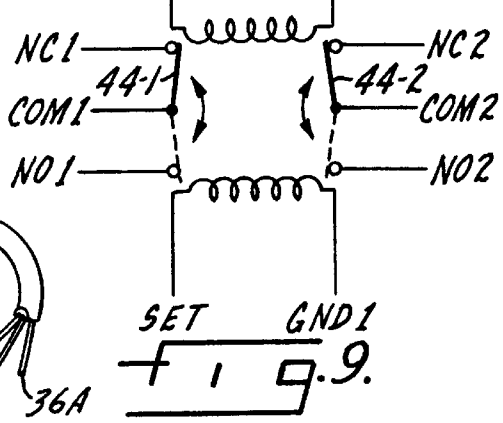
FIG. 9 is a circuit diagram of a latching relay.

A latching relay is associated with each output jack. One of these relays connected to jack J10 is shown at K4 The internal circuit of a latching relay is shown in FIG. 9. The relay is a double-pole, double throw device having first and second contacts 44-1 and 44-2. There are also two coils in the relay. Each coil is connected to a power source, at the terminals labeled SET and RESET, and to a ground, labeled GND1 for the SET coil and GND2 for the RESET coil. The contacts 44-1 and 44-2 are pivotably and electrically connected to common pins labeled COM1 and COM2. In what is designated the "normal" or latched condition, the RESET coil is considered the most recently activated coil and the contacts 44-1, 44-2 engage pins NC1 and NC2, respectively, thereby making electrical paths between NC1-COM1 and NC2-COM2. When the SET coil is activated it pulls the contacts 44-1, 44-2 into engagement with pins NO1 and NO2, respectively, thereby making electrical paths between NO1-COM1 and NO2-COM2. There is no spring or other device biasing the contacts 44 one way or the other so the contacts remain in their most recently activated state until the opposite coil activates to move the contacts to the other set of poles.

Returning now to FIG. 2, the connections to one of the latching relays K4 will be described, it being understood that the other relays have the same components connected thereto. The SET and RESET pins are connected to the 9 VDC source on lines 46 and 48, respectively. Pins NC1 and NC2 are not used. COM1 is connected by line 50 to pin 3 of output jack J10. Line 50 is also connected to selectable power line AC4A. COM2 is connected by line 52 to pin 1 of jack J10. Line 52 also branches off to an LED D10 that turns on when line 52 is active. NO1 is connected by line 54 to pin 3 of jack J10. NO2 is connected to the 5 volt power source VCC. GND1 connects to amplifier U9B through line 56. Line 56 branches to the 9 VDC power supply through diode D26. GND2 similarly connects to amplifier U9A through line 58 which branches to a 9 VDC power supply through diode D25.

The diodes D25 and D26 are there to help with inductive spikes. When there is a relay coil and it is turned on, the 5 volt line will drain so fast through U9A it now will draw as much power as possible. This drops line 58 so low that it could actually be lower than ground. In which case, there would be a current path but since diode D25 is not allowing power to go from +9 VDC to U9A, there will not be any current. But again when you turn the relay off you have an inductive spike going the other way. A low does not hurt the board but a high inductive spike might. In the case of a high inductive spike, a high rush of current is produced. So in this case, it is drained to ground to get rid of it. This helps with inductive spikes created by latching/unlatching of a relay.

The output of the microprocessor comes out of its ports IO0 through IO3 (FIG. 3). Four lines coming out of these ports connect to an addressing chip U10. U10 only allows one output to turn on depending on the combination of lines IO0, IO1 and IO2. IO3 is an enabler. It tells the chip when to work and when not to work. IO0, IO1 and IO2 are going to represent a binary number. That binary number specifies which output to turn on when the chip U10 is enabled by IO3. Only one of the outputs from U10 is going to be activated at a time. Thus, one of the eight amplifiers U9A through U9H (only three of which are shown) is going to amplify the signal from U10 to allow for a greater current path.

Typically, from U10, a turned "on" output is going to be a logic zero. When it is activated it is a logic zero. Otherwise it's a logic high. The amplifier U9 is going to amplify that. So on all the amplifiers except one there is normally going to be 5 volts coming out of the amplifier. One amplifier is going to have a logic low or logic zero. For example, if amplifier U9A is low, line 58 is pulled low, completing a current path through the reset coil and pin GND2 of relay K4 and causing contacts 44 to close on the NC1 and NC2 pins. The contacts will stay that way even when U9A and GND2 go high and shut off the reset coil. The relay contacts will not move until amplifier U9B goes low, taking line 56 and GND1 low and providing a current path through the set coil. With the set coil active the relay contacts 44 will be thrown to pins NO1 and NO2. With NO1 connected to COM1, the selectable voltage on AC4A and line 50 will be provided to line 54 and pin 3 of jack J10. At the same time the connection of NO2 to COM2 places the 5 VDC source on line 52 and pin 1 of jack J10. Once again the relay contacts will remain in this position even when U9B goes high and removes current from the set coil.

Since only one relay one coil is activated at a time and it is not necessary to maintain the power, the power consumption of the 4IO board is greatly reduced. For example, if the board is controlling a shower and the shower is to be on for 10 minutes, the microprocessor sends a 10 millisecond pulse to unlatch the relay and turn the shower on. The relay is left there. The processor comes back in 10 minutes, looks at its watch and says when 10 minutes expires, go to the other address to unlatch (reset) this relay and turn the shower off.

Figure 2:
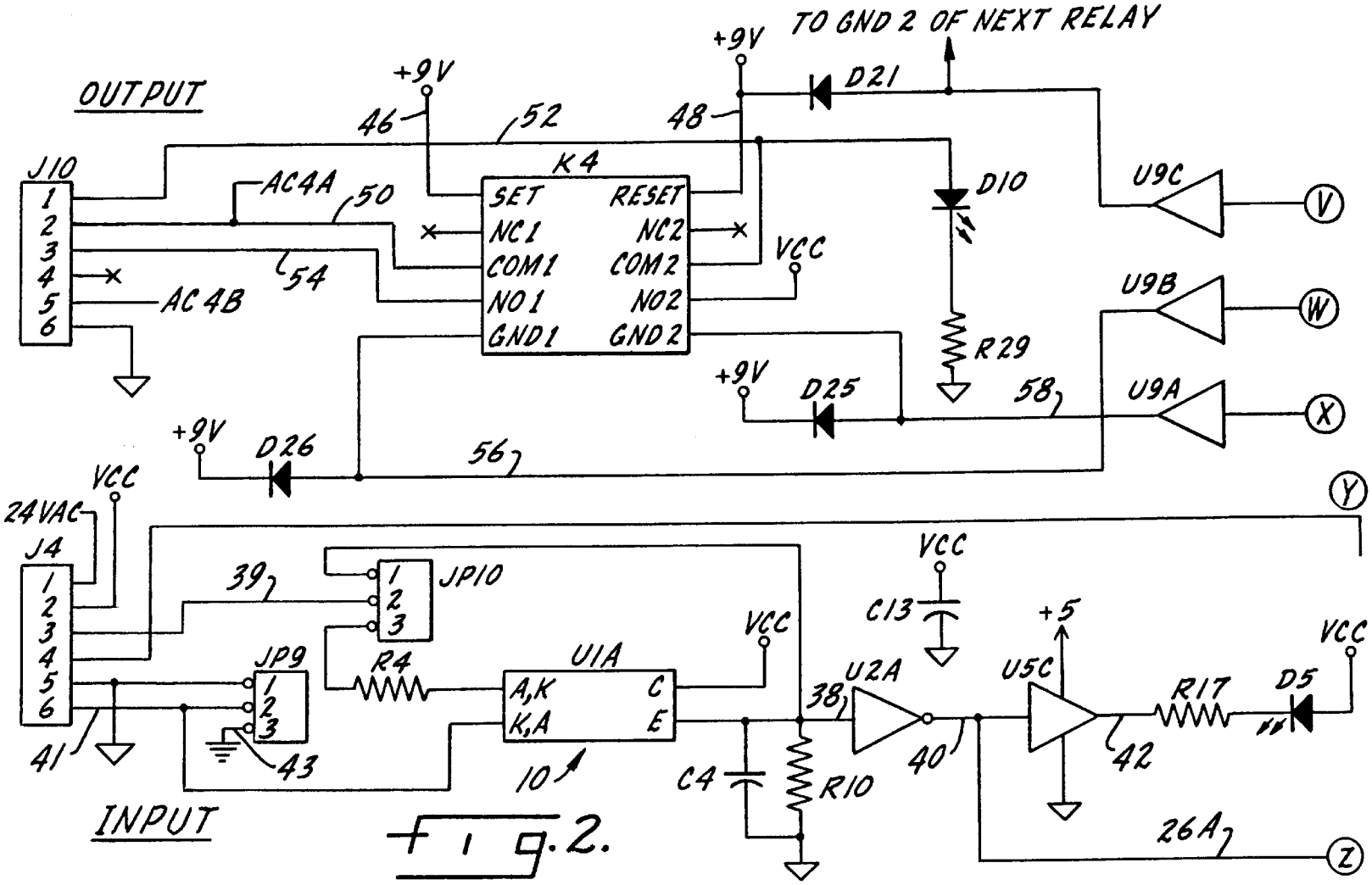
Figure 5:
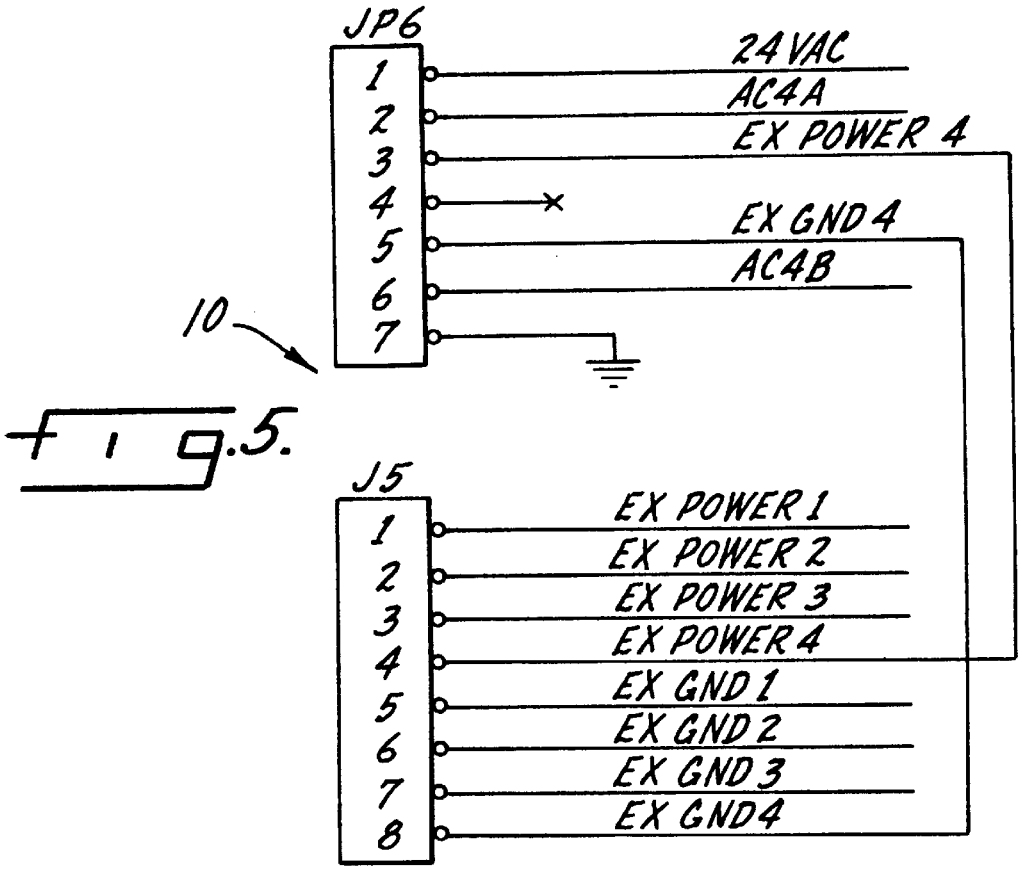
Figure 6:
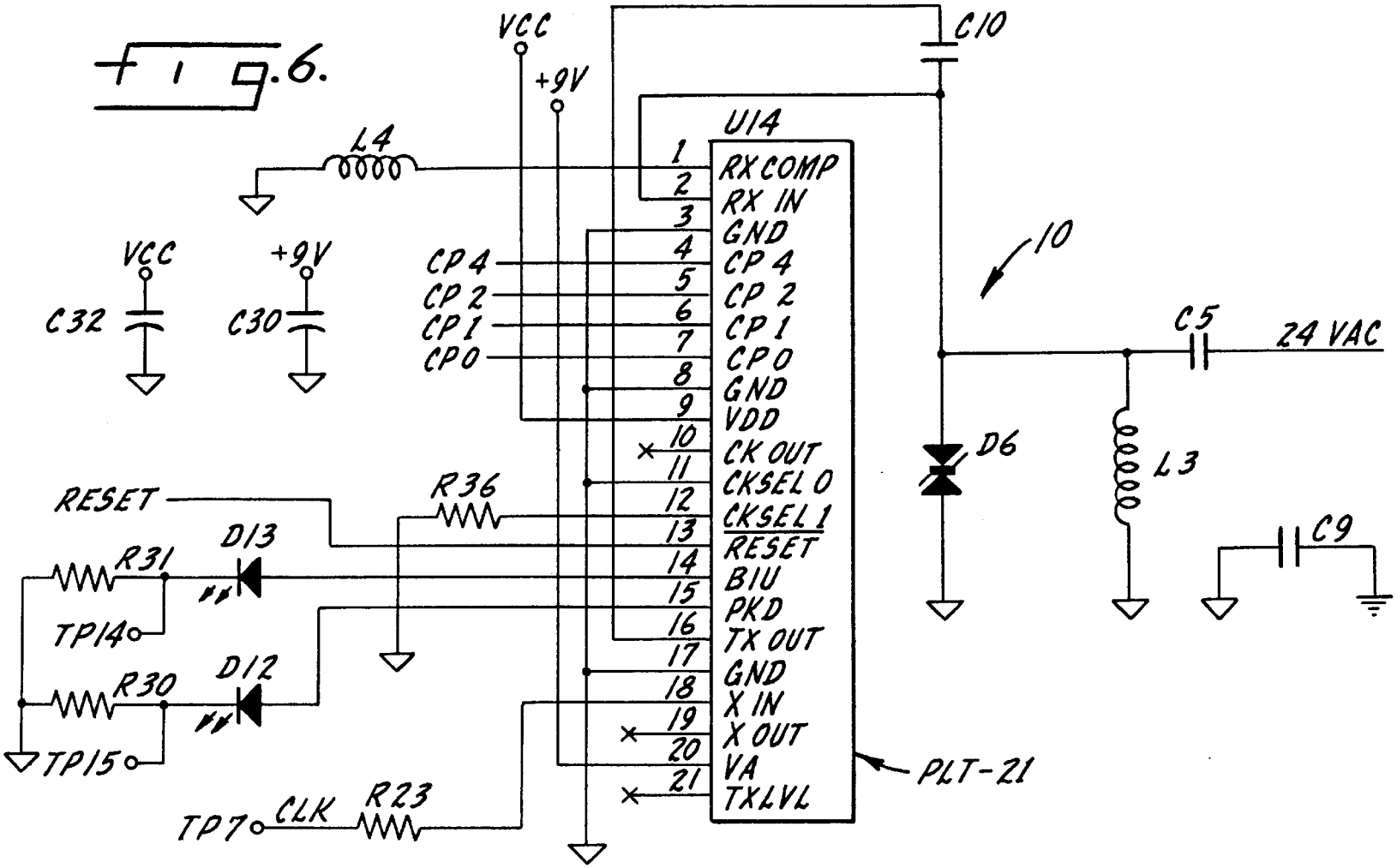

The selectable voltage at AC4A is determined by two shunt clips on a jumpers JP6 (FIG. 5). Keep in mind that there is one such jumper for each of the four output jacks and each jumper and output jack has its own selectable voltage line ACxA, where "x" can be 1,2,3 or 4. Each jumper, such as JP6 in FIG. 5, has on pin 1 a 24 VAC supply from line 14 of the power supply section 12. Pin 2 connects to line AC4A at line 50. Pin 3 connects to an external power source. Pin 4 is blank. Pin 5 is connected to ground for the external power source. Pin 6 is the return line from AC4B on pin 5 of jack J10 (FIG. 2). And pin 7 is an AC neutral.

The external power source, also referred to as an off-board power source, comes into the 4IO board at jack J5 in FIG. 5. J5 simply provides pins for four external power sources and related grounds therefor. These are connected to pins 3 and 5 of each of the output jumpers JP6. Thus, if a controlled device requires a voltage other than the 24 VAC or 5 VDC available from the 4IO board's power section, that off-board voltage could be supplied to jack J5. One jumper shunt clip on JP6 would be set to pins 2 and 3 so external power would be provided on AC4A and thus on pin 2 of output jack J10. Furthermore, a switched external power would be available on pin 3 of J10. The other jumper shunt clip would be placed on pins 5 and 6 of JP6 to connect AC4B from pin 5 of J10 to external ground at JP6 pin 5.

If the controlled device needs 24 VAC, the jumper JP6 shunt clips are set on pins 1 and 2, and pins 6 and 7. That places 24 VAC on AC4A and AC4B, which in turn are connected to pins 2 and 5 of output jack J10. Also, a switched version of the 24 VAC source would be available through COM1-NO1, line 54 and pin 3 of J10. If the controlled device needs 5 VDC, that's going to always be available at pin 1 of J10 (when K4 is unlatched), regardless of the jumper JP6 settings.

It will also be noted that if the controlled device has its own power supply but it is desired to switch that power supply (control when the device turns on and off), pins 2 and 3 of J10 could be tapped into the power circuit on the controlled device. Contacts 44-1 at the NO1 and COM1 pins would complete the power circuit when the set coil of relay K4 is activated. Thus, the relay can simply provide a switch closure. In this case the jumper shunt clips would be removed from JP6 so nothing is supplied to AC4A or AC4B.

From the foregoing it can be seen that the microprocessor can control the supply of different on-board voltages, or an-off board voltage or just provide a switch closure to a controlled device.

E. Communications and Utilities

Figure 7:
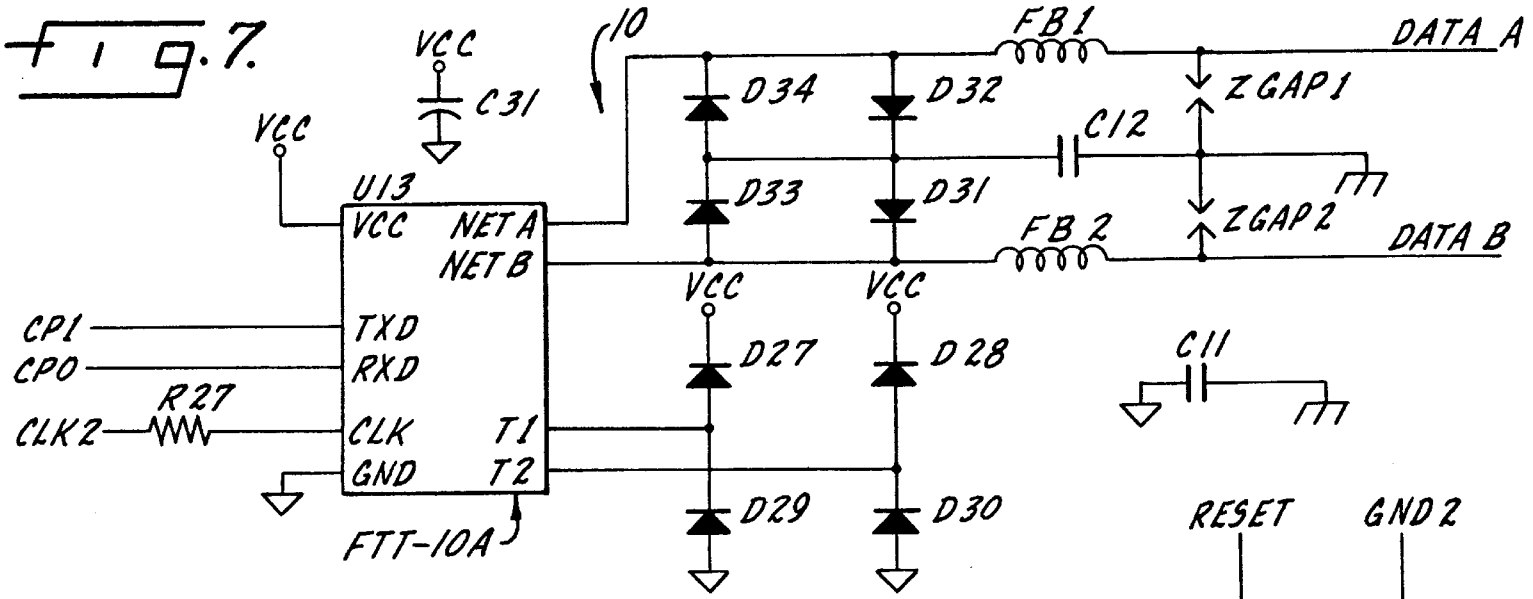

The 4IO board has the ability to communicate through twisted pair lines or a power line. The twisted pair communications module is known as FTT-10A as is shown in FIG. 7. The power line module is indicated as PLT-21 in FIG. 6. These are both stuffing options, whichever one desired can be used. The FTT-10A can be bus or star topology. It is just a matter of the type of communication package desired. Other options such as RS485 might also be used. Both the FTT-10A module and PLT-21 transceiver can be obtained from Echelon Corporation of Palo Alto, Calif. The communication lines CP1, CP0 and CLK2 of the FTT-10A option and the PLT-21 option extend from the microprocessor to the communications module. The microprocessor sends out a series of 1's and 0's on each of these lines. The transceiver is really a big transformer, an isolation transformer, and it sends out those same clocking signals in serial fashion on either line Data A or Data B (FIG. 7). The transceiver on the other end looks at the two lines and when a difference is detected then there must be communication. Then the receiver starts looking at the combination of 1's and 0's to determine if it is a valid message or not. This type of transmission is known as Manchester differential encoding. Since signals are sent on Data A or Data B polarity is not a concern. That is, the two wires can be hooked up in either fashion.

The only difference with power line communication is there are more communication lines hooked up and there is a little intelligence in the chip that stores some of the information and then sends it out at a slower rate. But essentially the same type of differential Manchester encoding applies with the power line transceiver. The transmission is slowed down a little bit and also it has the intelligence to look at the power line to see if there is traffic on the line or not.

The other components shown set up the voltage that is used for the comparison by the transceiver. An inductor helps reduce noise spikes and things like that and it is just cleaning up the communication on a line.

Returning to FIG. 3, the 4IO board has a reset switch SW1. If something goes drastically wrong or it is desired to start from a known beginning the reset switch is pressed. It tells the processor forget whatever you're doing, start from scratch. Start from the very beginning of your program. It does not affect the EE section of the microprocessor. It only tells the processor to stop what you're doing and start from the very first step of your program. That first step may be to turn all the relays off as a safety precaution.

U11 is a chip that makes sure that the voltage is maintained. U11 is a chip that acts like a watchdog for the 5 VDC power. It makes sure that the 5 VDC does not drop below 4.3 volts. It is a security measure to make sure that the processor does not produce errors due to low voltage. When the 5 VDC line drops below 4.3 volts U11 will automatically tell the processor to reset. U11 will keep sending that signal until the 5 VDC line is back above 4.3 volts. This chip reset does the exact same thing as the push button reset SW1. It just tells the processor to start from the beginning. As long as that reset is held low, the processor is not going to work. It will be in continual reset. If a processor is allowed to free wheel or work on its own when the power drops below 3.8 or 3.7 volts, it does not have enough power to latch information into its memory so there may be some old information, some new information, or a combination of old and new information. The processor is trying to operate but the data is completely unreliable. You just do not know what is in the processor's memory. U11 protects against that happening.

The service switch SW2 is a special switch typically used in a communication format. When the service switch is pressed it invokes a special routine in the processor. It tells the processor to send out its unique neuron ID number and to identify itself with that unique neuron ID number. So it will make a message that says this is my unique neuron ID number and it will throw it out on the communication line. That's what that service switch does. Also embedded in the software there is the ability through a combination of reset and the service switch to go into what is called an unconfigured state. Typically that is used when something is going very wrong or something needs to be changed drastically or you need this board not to work for some reason. You can force the board not to work by going into an unconfigured state. That is usually used as a diagnostic tool or if new information is going to be downloaded that will take a long time.

J6 in FIG. 3 provides some extra input output points that can be configured through programming to do pretty much whatever is needed. Since they are not used in the circuit they were brought out to a header with a 5 VDC power and 5 VDC ground so this can be used at a future date. In most cases it is not being used. It is for future expansion. In the case of the Smart Sink there is another board attached to J6 that has three pushbuttons. Those three pushbuttons interact with the software to talk to another display to change parameters just like would be done through a personal computer.

The 4IO board has a ground shield to eliminate radio emissions from going in and out of the board. Internally there is foil that goes around the entire board except where the traces go through. That acts as a shield to help prevent radio emissions from affecting the data lines externally because we have all these 1s and 0s running back and forth. Naturally, that's going to cause noise. To prevent it from radiating out to the world, an earth ground shield is embedded in the board. That noise will tend to go to that earth ground shield. So, the noise that we generate from our board is going to be drained to ground and the noise from the outside world is going to be drained to ground by the same shield.

F. 4IO Software

Figure 10:
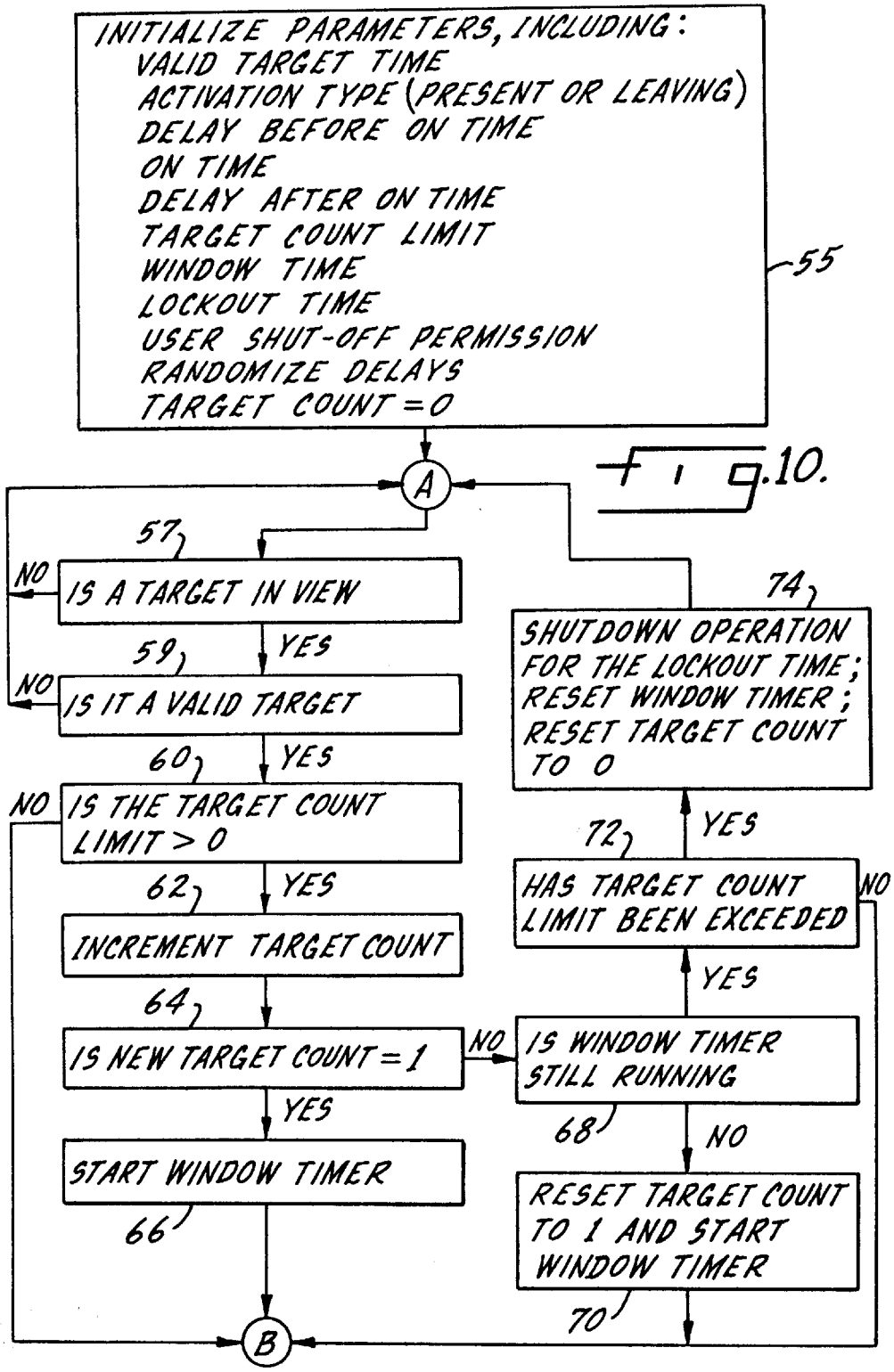
FIGS. 10 and 11 comprise a flowchart of the 4IO software.
Figure 11:
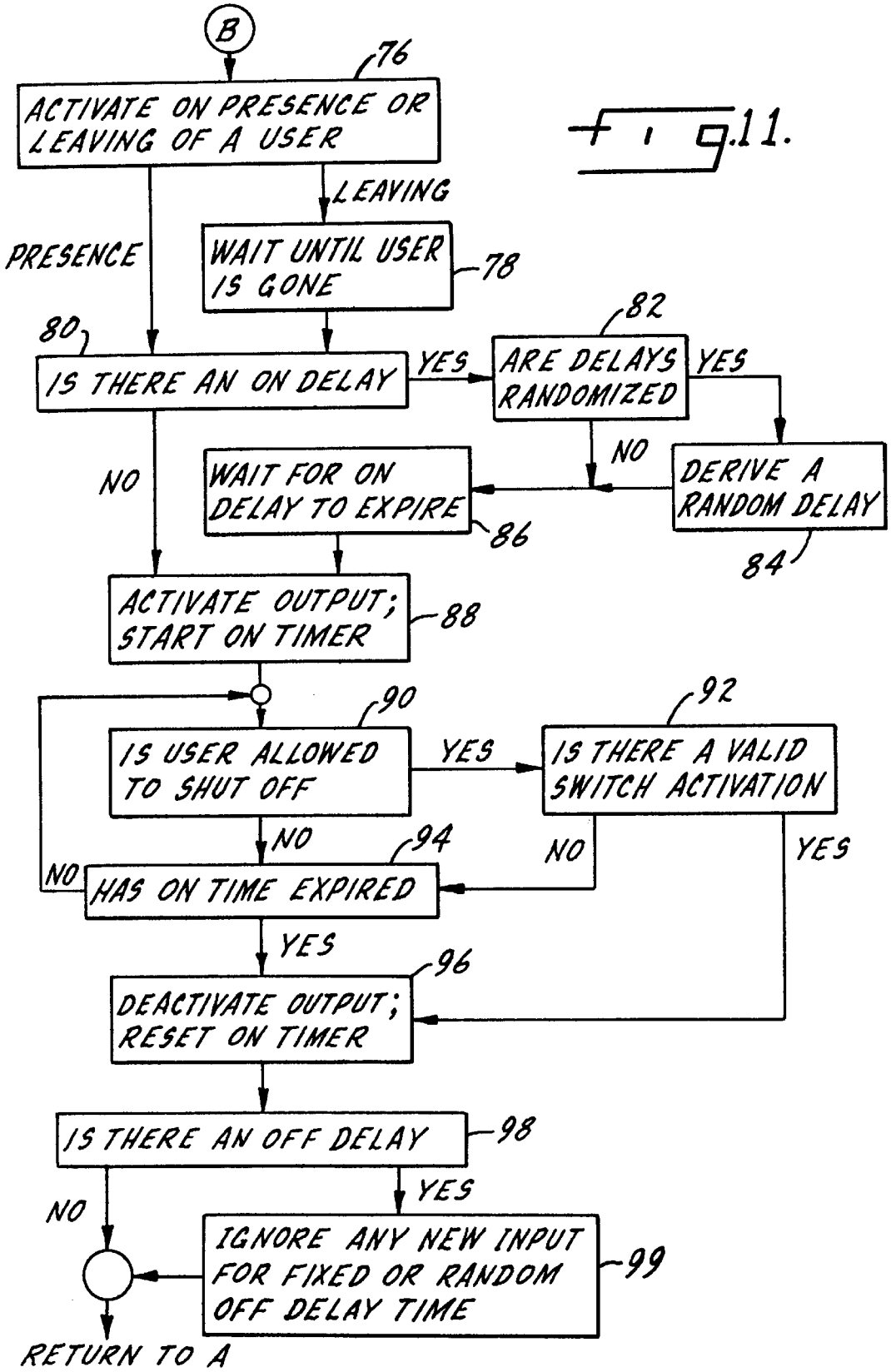

The software for use on the 4IO board is stored on the EPROM U3 and runs on the microprocessor U12. FIGS. 10 and 11 illustrate a flowchart for a preferred general program for use with a variety of plumbing fixtures. The flowchart only shows the program steps for a single input and output channel; it will be understood that the steps for the other channels are similar.

The program begins at 55 by initializing a set of parameters for each particular input and output channel. The parameters include:

Valid target time—this is the length of time an input signal must be present before the computer recognizes it as a valid input. While the term "target" envisions an infrared sensor as the activating device on the fixture, it also is meant to encompass the actuation of a pushbutton switch or the like.

Activation type—this tells the computer whether it should act on a valid target signal when the signal appears or after the signal disappears. This is to accommodate fixtures such as water closets that should not be activated until a target, i.e., the user, leaves the fixture.

Delay before on time—this is the length of time the computer should wait before activating an output after a valid target is seen and the appropriate activation type is allowed for.

On time—the length of time the computer should allow activation of the fixture. As explained above since the latching relays are used to control the outputs, the on time is not synonymous with the actual pulse length from the computer, which is very short. But if left unlatched the relay can be allowed to provide an output for a long time.

Delay after on time—this is the length of time, after activation of the fixture, during which further inputs are ignored. This is to give the fixture time to carry out its operation. Most commonly this will be used with a water closet where it may take ten seconds or so to complete a flush. During that time you don't want a new flush request to interrupt an incomplete prior flush. So the delay after on time is used to suppress new inputs following too closely on a previous one.

Target count limit—in certain situations it is necessary to limit the number of fixture operations within a certain window of time. For example, if a request for flushing a water closet in a prison cell is received more than twice in a five minute span it is likely that an inmate is up to some mischief by issuing repeated flush requests, i.e., hitting the flush button over and over. The target count limit sets the maximum number of times a request will be accepted within the window.

Window time—this is the length of time associated with the count limit just described. When a first request is received a window timer is started and a target count kept and checked to see if it exceeds the specified limit. In the embodiment shown there is only one window timer and it is not reset until it times out. Alternately there could be multiple window timers with each target starting an additional window so that the target limit is never exceeded in any time frame, not just the one kept by a first timer. Another way of handling the issue of multiple targets spanning the end of a first window is to randomize the on delay and off delay times. A longer off delay has somewhat the same effect as multiple time windows.

Lockout time—the length of time an output is shut down if the target count limit is violated. During the lockout time the computer will acknowledge no inputs and provide no outputs. If the 4IO board is part of a PWT network the violation is reported to the central computer.

User shut off permission—this parameter governs whether a second switch or sensor activation by a user will turn off the fixture prior to its run time limit. For example, can the user turn off the shower before the ten minute time limit.

Randomize delays—this tells the computer whether it should use fixed on/off delays or generate delays of random length.

Target count—this is the number of times that the pushbutton switch or infrared sensor on a fixture has been actuated by a user. It is ignored if a lockout is not used. It is initialized at zero, incremented by each valid target and reset to one when the window timer times out and to zero when the lockout timer times out.

Returning now to FIGS. 10 and 11, after initialization and junction point A, the computer proceeds to monitor the input line for a target at 57. When a target is seen (i.e., a pushbutton is pressed or an infrared sensor is tripped), the computer waits at step 59 to see if the target remains for the specified valid target time before recognizing the target as valid. Once a valid target is found the computer checks at 60 to see if target count limits are imposed on this channel. If not it proceeds to junction point B, with subsequent actions explained momentarily. If count limits are in effect, the target count in incremented at 62 and checked at 64. If this is a first target (i.e., we are not presently in a window period), the window timer is started, 66, and the computer goes to junction B. If this is not a first target, the computer checks at 68 to see if the previously set window has expired. If it has, a new window is started and the target count is reset to one, as at 70. If the window is still in effect, the target count is compared to the limit at 72. If the limit has not been exceeded we go to junction B. But if the target count limit has been exceeded, the computer shuts down operation of both the input and output on this channel, starts a lockout timer, resets the window timer and resets the target count, 74. Operation will resume only after the lockout timer times out.

Following junction B, the computer checks if it is ok to actuate the fixture upon presence of the user or if it is to wait until the user leaves the fixture, 76. If this parameter is set to "Leaving" the computer waits at 78 until the target is no longer seen. Next the computer checks if there is an on delay, 80. If there is an on delay, the computer checks to see if it a random delay, 82. If so the computer determines a random delay at 84, otherwise it uses the specified fixed delay to wait, 86, prior to activating the output. Activation at step 88 involves a pulse to the appropriate latching relay and starting an on timer. During the run or on time, the computer will check at 90 if the user has shut off permission. If so, the computer will look for a valid target or switch activation, 92, and shut off the output if it finds one. Otherwise the computer simply watches the on timer at 94. With either expiration of the on timer or a valid shut off request, the computer turns off the output and resets the on timer, 96.

The computer next determines if there is an off delay, 98. If so, any new pushbutton or sensor activations by the user are ignored during the off delay time, 99. The off delay may be either fixed or random as previously determined. Finally, the computer then returns to junction point A and starts watching for the next target.

It can be seen that the basic control logic for an output is delay-activate-delay within imposed cycle limits. This basic logic suffices for a wide variety of applications but obviously it could be changed through new software in the EPROM. For illustrative purposes only, a specific example of the parameter settings in shown in the following table. This example assumes the 4IO board is connected to combination fixture having a sink with hot and cold water on IO channels one and two, a water closet on IO channel three and a shower on IO channel four.

| | Hot Water | Cold Water | Water Closet | Shower |
|---|---|---|---|---|
| Parameter: | 1 | 2 | 3 | 4 |
| Valid target time (millisecs) | 100 | 100 | 100 | 1000 |
| Activation on present or leave | P | P | L | P |
| Delay before on (seconds) | 0 | 0 | 2 | 0 |

-continued

| | Hot Water | Cold Water | Water Closet | Shower |
|---|---|---|---|---|
| On time (seconds) | 20 | 10 | 3 | 600 |
| Delay after on (seconds) | 0 | 0 | 120 | 0 |
| Cycle count limit | NO | NO | 2 | NO |
| Window time (seconds) | 0 | 0 | 300 | 0 |
| Lockout time (seconds) | 0 | 0 | 1800 | 0 |
| User shut off permission? | YES | YES | NO | YES |
| Randomize delays? | NO | NO | YES | NO |

It can be seen with the above setting the hot, cold and shower water will be supplied without delays or cycle limits and the user can shut them off. The water closet, however, can only be actuated twice in five minutes and randomized delays will be supplied both before and after activation, thus giving the flush valve time to operate.

II. Smart Sink

A traditional hand washing apparatus will not always assure that a proper hand washing sequence has been conducted. To activate the traditional apparatus, the user will be required to physically touch the fixtures at each station of the apparatus, such as the faucet handle, soap dispenser lever or paper towel dispenser handle. These fixtures might contain contaminants which can be transferred to the user's hands. In addition, the careless user might skip a step in the hand washing process or conduct a step improperly to obtain proper hygiene, such as obtaining little or no soap, or allowing an insufficient scrubbing time period.

The use of a programmed washing device was taught by Griffin, U.S. Pat. No. 3,639,920. Griffin taught the use of a continuously sequenced washing device in which water is discharged for a predetermined interval, after which the water will be turned off and the soap will be dispensed for another predetermined interval. This is followed by a predetermined pause during which neither soap nor water is dispensed. Thereafter, the flow of water is reinstated and the flow continues until the user departs from the plumbing fixture.

While a continuously sequenced washing device assures every step of the washing cycle is conducted, the inflexibility of a continuously sequenced washing device creates some additional problems. The user is only allowed usage for a predetermined time interval at each station. A user desiring a more extensive hand washing procedure is not allowed the flexibility to remain at any one station for a longer period of time than the predetermined time. Hence, a user requiring more soap during the scrubbing period to conduct a proper hand washing will not be allowed to do so. This inflexibility prevents assurance that a proper scrubbing procedure was conducted. In addition, a continuously sequenced washing device does not allow the user to use only one particular station or vary the time interval to better suit the particular situation.

The present invention overcomes the problems described above by using a separate sensor for each of the three units in the apparatus, namely, the faucet, soap dispenser and paper towel dispenser. Each of these sensors are connected to the 4IO board. The 4IO board can operate in either in a smart mode or a random mode. The user may be provided with the option of selecting the mode of operation through the use of a menu select switch. The user may also have access to an override switch that bypasses the 4IO board and turns the faucet on.

The smart mode allows a flexible, sequenced hand washing cycle. In the smart mode, a proper hand washing procedure comprises a hand wetting interval, then a dispensing of soap followed by a scrub time interval, then a rinse time interval followed by a dryer activation and, optionally, an output that verifies completion of a proper hand washing sequence. The time for the scrub time interval can be preprogrammed to suit the particular situation necessary for obtaining a proper wash. During this scrubbing period, the user will not be able to obtain water for rinsing off the soap, hence, assuring that the user will not be able to continue without conducting a proper scrub. Since separate sensors are used for each station, the user is able to control the length of the wetting and rinse intervals, as well as the number of dryer activations. Thus, the user can obtain additional water (during wetting or rinse only), soap or paper towel if additional water, soap or paper towel are desired by the user. What the user cannot do is shorten the scrub time and still obtain verification of a proper wash sequence.

In smart mode the paper towel dispenser sensor is always active so paper towel is always available. Also, if available, the override switch could be used to force the faucet on for rinsing. Should the user have an urgent need to interrupt the hand washing procedure, the smart mode will allow the user to immediately dry his or her hands. Obtaining paper towel out of sequence or activating the override will preclude issuance of a verification of a proper wash sequence but it will permit a user to meet an emergency without soap covered hands.

To assist the user in the sequence of steps to be taken for obtaining a proper hand wash, a display board is used to instruct the user in the proper operation of the sink. The display board is connected to the 4IO board via a communication link.

When the user wishes to use one of the washing stations independently from the other stations, the user can select a random mode. In the random mode, each sensor is active to allow each unit to be used separately, without interaction among the stations.

The 4IO board will also have the ability to monitor the number of times the faucet, soap dispenser and paper towel dispenser was activated and, if desired, by whom. This data can then be retrieved and logged to a central computer. It will be understood that the software used by a 4IO board connected to a Smart Sink is different from that shown in FIGS. 10 and 11.

Turning now to the details of the Smart Sink hand washing apparatus, it comprises a wash basin (not shown) with a faucet mounted thereon. Adjacent the basin are a soap dispenser and a towel dispenser, both motor-driven to provide soap and towels at the appropriate time. Each of the faucet and soap and towel dispensers has a sensor associated therewith. A VFD/LCD display is placed near the sink at a height where it will be easy to read.

Figure 12:
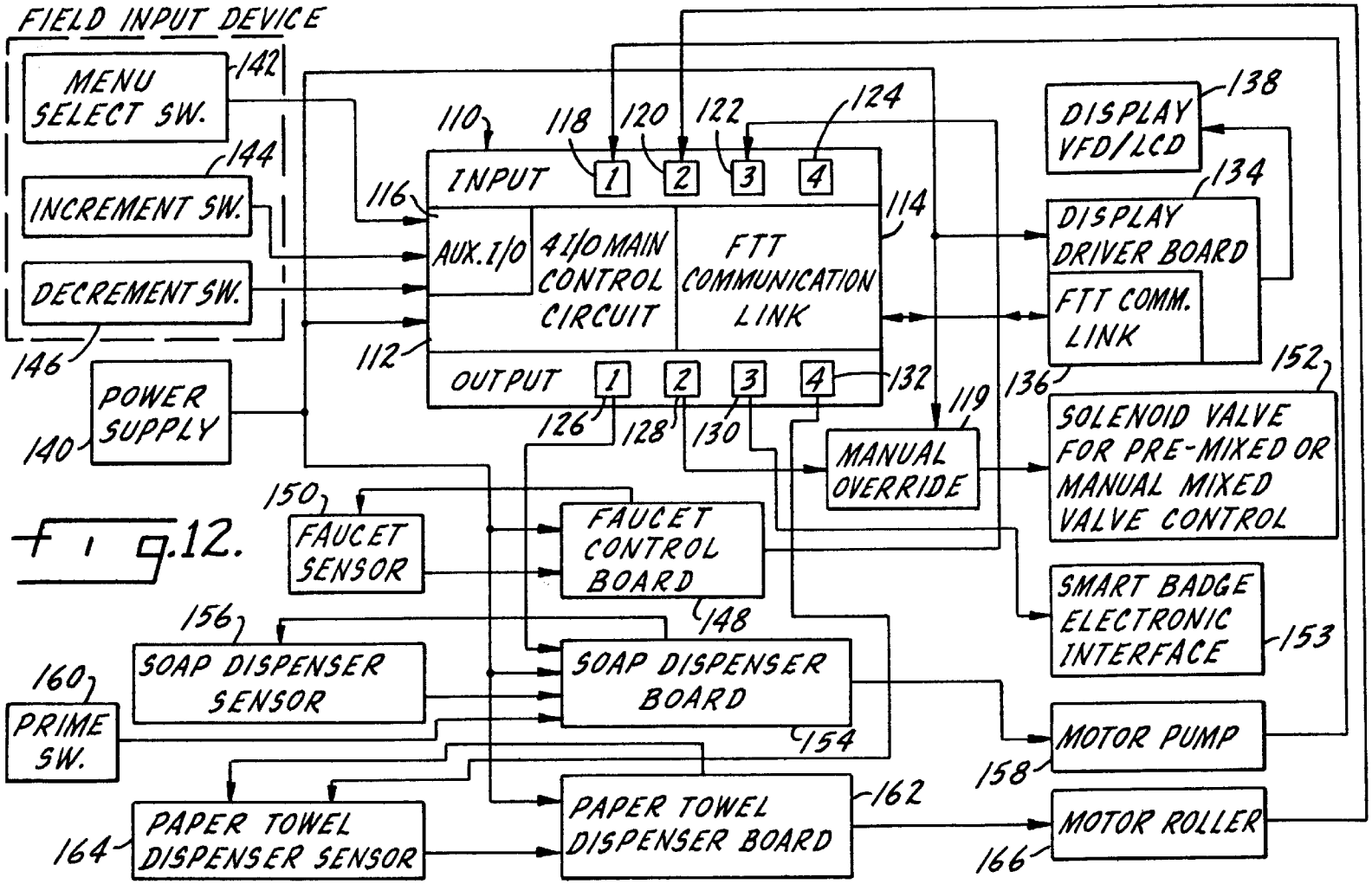
FIG. 12 is a block diagram of the Smart Sink.

Referring to FIG. 12, one electromechanical solenoid valve 152 is mounted in the water supply line, after a pre-mixing device or back check valves, to control the flow of water to the faucet. The valve 152 is off (closed) when no power is supplied to it and on (open) when power is supplied to it. A faucet sensor 150 is mounted in the vicinity of the faucet. A common arrangement is to have an infrared emitter mounted in the neck or base of the faucet and aimed at a point underneath the faucet outlet. An infrared detector is located adjacent the emitter.

A faucet control board 148 contains a power supply, IR filter, signal conditioner, and output driver. The board 148 also has a 24 VAC input from power supply 140. Power supply 140 is a transformer for converting the line power 120 VAC to 24 VAC. Faucet control board 148 generates a continuous pulse signal and sends it to the faucet sensor 150. The emitter receives the pulse signal from the faucet control board 148, and sends an infrared signal out to its target zone. When a user places his or her hands underneath the faucet, and therefore in the target zone of the emitter, infrared light will be reflected off the hands to the detector, thereby triggering a return signal to the faucet control board, which processes the signal to determine if it is a valid target. If so, the target is reported to the 4IO board through jack 122. The 4IO board in turn may cause the faucet to turn on, depending on the status of the 4IO software.

Mounted adjacent the basin is a soap dispenser having a motor driven pump 158 for dispensing liquid soap. A soap dispenser sensor 156 is arranged so when a user places his or her hands under the dispenser nozzle, soap will be pumped onto the user's hands. Soap dispenser board 154 contains a power supply input, timing set up, variable timer, variable motor driver and a soap priming circuit. This circuit is controlled by the 4IO board 110. The circuit is on when it receives a command from the 4IO board, otherwise it is off. When the soap dispenser is on, it will supply power to the soap dispenser sensor 156 and wait for the return signal. When the target is valid, it will turn the soap pump on, and dispense soap for a predetermined interval. The circuit also provides a prime switch input.

Soap dispenser sensor 156 contains an IR emitter, IR detector, and the supporting filter components. This sensor is arranged in the break beam method. Peristaltic motor pump 158 will dispense soap when power is supplied to it. When the prime switch 160 is pressed, the pump 158 will operate. This function is used when an installer needs to get the liquid soap to the nozzle quickly. It is normally used at the time of filling the soap reservoir.

Also mounted near the basin is a towel dispenser which dispenses paper towel or the like when rollers in the dispenser are actuated by an electric motor 166. A paper towel dispenser sensor 164 can activate the roller motor 166. Paper towel dispenser board 162 contains a power supply and a motor drive. The power supply provides power to paper towel dispenser sensor 164 and waits for the return signal to turn on the motor roller 166.

Paper towel dispenser sensor 164 contains IR emitter and detector, filter, timing set up, and output driver. This sensor has an input pin that receives the signal from the 4IO board's output jack 132 and activates the roller to dispense paper towel. A blow dryer could be substituted for the towel dispenser.

The VFD/LCD display 138 has a driver board 134 which includes a power supply (not shown) and an FTT communication link 136 for talking to the 4IO board 110. Display driver board 134 will receive data from a 4IO board 110, then send the data to display board 138 to display the message(s), and return the message back to the 4IO board 110 for acknowledgement.

Overall control of the Smart Sink is governed by the 4IO board. FIG. 12 shows schematically its main control circuit 112 (comprising primarily microprocessor U12 and EPROM U3), the twisted pair (FTT) communication link 114, and an auxiliary I/O 116 (connector J6 on the 4IO board). Auxiliary I/O 116 has a total of three auxiliary pins that can be configured to be inputs or outputs.

The auxiliary I/O 116 can be connected to a menu select switch 142, an increment switch 144 and a decrement switch 146. These three switches together form a field input device which allows alterations of the timing parameters used by the 4IO board. For example, the menu select switch could be used to display the required scrub time, and the increment and decrement switches could be used to raise or lower that time. The field input device is available only to the sink owner, not to users.

Every time the menu select switch 142 is pressed, a pulse is sent to the 4IO board 110. It then sends a message out to the display 138, and by scrolling one message is displayed at a time on the display. After selecting the desired changeable function through the menu select switch, changing the function is accomplished through the increment and decrement switches. Increment switch 144 sends a pulse to the auxiliary I/O 116 every time the increment switch is pressed. The 4IO board 110 will increase the timing count value and send this value out to the display. Similarly the decrement switch 146 sends a pulse to the auxiliary I/O every time the decrement switch is pressed. The 4IO board 110 will decrease the timing count value and sends this value out to the display. For example, to change the scrub time from 10 seconds to 15 seconds, the owner's technician would first press the menu switch 142 until the scrub time is displayed. The technician would then press the increment switch 142 until 15 seconds is displayed on display 138. Finally the technician would press the menu switch.

As described above the 4IO board 110 also consists of four input connectors and four output jacks. Input jack 118 is connected to the soap motor pump 158 and receives a feedback signal from the soap motor pump 158 as to whether it has been activated. Similarly, input jack 120 is connected to the paper towel dispenser motor roller 166 and receives a feedback signal from the paper towel dispenser as to whether it has been activated. Input jack 122 is connected to the faucet control board 148 and receives a signal from that board. The signal will go to the microprocessor which determines when to turn on the faucet. Input jack 124 is not used at this time although it might be used for sensing input from a user's badge which is equipped with a radio transceiver.

Output jack 126 is connected to soap dispenser board 154 which activates the soap dispenser motor pump 158. Output jack 128 is connected through manual override 119 to solenoid valve 152. Output jack 130 is connected to the Smart Badge electronic interface 153. Output jack 132 is connected to the paper towel dispenser board 162.

A Smart Badge is a device worn by users that has a radio receiver or transceiver and data recorder. When a valid hand washing sequence is completed, output jack 130 is activated long enough for the Smart Badge electronic interface 153 to send a radio signal to a Smart Badge verifying a valid hand washing sequence. The Smart Badge will record the fact of receiving the verification signal and set itself to allow a user to pass other antennas or check points in the facility.

FIG. 12 shows output jack 132 from the 4IO board to the paper towel dispenser board 162 and the paper towel dispenser sensor 164. This was done for the convenience of wiring up the system. The wires from the sensor 164 are connected to the dispenser board 162 before being connected to the 4IO board 110. Alternatively, the connection from the 4IO board to the paper towel dispenser sensor 164 can be directly tied together.

Manual override 119 consists of a rocker switch and a power supply input. This rocker switch can be set to let the 4IO board assume control of the solenoid valve 152 or to turn the solenoid valve 152 on regardless of the 4IO board's output. In normal operation, the override switch 119 is set to allow the 4IO board to control the valve. But the rocker switch can also be set to turn the solenoid valve on regardless of the 4IO board's output.

The owner of the Smart Sink can choose whether to give a user access to the manual override 119. Similarly, the owner can choose whether to give a user access to the menu switch that will permit selecting smart mode or random mode. It is contemplated that most installations will provide access to the override switch but not the menu switch. However, it depends on the owner's desires for a particular facility.

When the smart mode is in effect, at the beginning of a wash cycle, the message board 138 will display "Welcome to the Sloan Smart Sink . . . Please Wet Your Hands". When hands are detected under the faucet, the water is turned on for as long as the hands remain in the target zone. Thereafter, the message on the message board will be changed to "Please Get Some Soap". At this time, the soap dispenser sensor 156 will be made active. The user then has the option of getting more water or more soap. If the hands are not detected by either the faucet or the soap dispenser with forty-five seconds, the Smart Sink will restart at the beginning of the wash cycle. If the hands are detected under the soap dispenser within the forty-five seconds after the hands are no longer detected under the faucet, the soap dispenser pump 156 will turn on to dispense a premeasured amount of soap. The 4IO board will then turn off the power to the water solenoid and disregard the faucet sensor.

The scrubbing time period is preprogrammed to suit the particular situation. To assure proper scrubbing by the user, the faucet sensor 150 will be disregarded and the water solenoid will be deactivated during the scrubbing time interval such that no water can be obtained during this period. The soap dispenser sensor 156 and paper towel sensor 164, however, do remain active. During the scrubbing period, the message board 138 will display "Please Scrub Hands For: . . . " the time remaining for the programmed scrubbing time period, with the time counting down. If the hands are detected again under the soap dispenser during the scrubbing period, an additional premeasured amount of soap will be dispensed and the timer will be reset for the entire programmed scrub time interval. The message board will be changed correspondingly to reflect the reset scrubbing time period.

After the scrubbing period is complete, the faucet will turn on, off, on and then off in half second spurts. This signals the end of the scrubbing period. Then the message on the display will change to "Please Rinse Hands Off". At this time the user can get soap again (which will cause the scrubbing sequence to be restarted) or get water. If a choice is not made within forty-five second, the Smart Sink will start at the beginning of the wash cycle. If the hands are detected by the faucet sensor within the forty-five seconds after the end of the scrubbing period, the water is turned on for as long as the hands are detected.

When the hands are no longer detected under the faucet, a complete hand washing has occurred. The complete hand washing is logged on the 4IO board 110. The 4IO board sends a signal to the paper towel sensor 164 via the paper towel dispenser board 162. This creates an automatic paper dispense, a reward for completing a correct hand washing. At the same time the 4IO board 110 sends a signal to the Smart Badge electronics interface 153 (if attached) that a complete hand washing has occurred. The Smart Badge electronics interface will then send a verification of a complete hand washing to the Smart Badge that the user is wearing. Also at the same time a message is sent to the display board 134, "Please Take a Paper Towel". If a paper towel dispense is not detected by the 4IO within ten seconds, the Smart Sink will start at the beginning of the wash cycle. If a paper towel dispense is detected by the 4IO board, during the dispensing period, the display will show the message, "Thank You And Have A Nice Day". Five seconds after the last paper towel dispense, the Smart Sink will reset to the beginning of the wash cycle.

The user can get paper towel at any time throughout the smart mode hand wash operation. If the user takes a paper towel at any time other than when he or she is instructed, an invalid hand washing occurs and will be so noted by the 4IO board.

The other mode of operation the user may be permitted to select is the random mode. When the Smart Sink is operating in the random mode, all the control boards work independently of one another within their own operating parameters and all the sensors for detection in their respective sensing zones of control are activated. When the random mode is selected, the message board will display "Welcome to the Sloan Smart Sink . . . Random Mode". The user can obtain water, soap or paper towel in any order, for any length of time.

III. Programmed Water Technologies

The purpose of the PWT Network Manager is to provide a means of communication between a Lonmark compliant control board and a computer. This software is used to monitor and/or change any Lonmark compliant network variable. The PWT Network Manager allows a computer to remotely install, replace, monitor, control, collect and print data on Lonmark compliant control boards. The 4IO control board is a Lonmark compliant control board.

A particular application of the PWT Network Manager software is in correctional institutions. Such facilities typically have multiple buildings, each with multiple floors and/or wings. Multiple rooms or cells are usually located on each wing or floor. The cells may have facilities such as a sink, water closet and possibly a shower. These can be controlled as described above by a 4IO board. The PWT software takes this concept a step further by permitting a remote PC to monitor, log and control any and all fixtures throughout a site. Each 4IO board becomes a node on a network that is managed by the PWT front end software. The PWT software interacts with Lonmark compliant boards. Lonmark is a trademark of Echelon Corporation and refers to that company's method of packaging variables and information in a known fashion so it can be sent across a network and read by a receiving node.

The PWT Network Manager is unique because it allows Lonmark compliant to boards to send information that will be displayed on a computer display. It also allows Lonmark compliant board installation on a communicating network. The network can have up to 64,535 Lonmark compliant boards. Information can be bound or sent from one board to another or from groups of boards to other boards. The PWT software can interact with computers that use TCP/IP protocol transceivers and the PWT Network Manager software.

The software can be set to one of three modes of operation; stand alone, server, or client operation. In stand alone operation, a personal computer (hereinafter "PC") can interact with Lonmark compliant boards and one other PC via a phone modem connection. In the server mode of operation, the central PC assumes that there is at least one network card that can support TCP/IP protocol. The PC in server mode can interact with other PCs that are running the PWT Network Manager program in the client mode and are connected to the same network. A server PC can also interact with one PC via a phone modem connection and it can interact with multiple Lonmark compliant boards. A PC in client operation assumes that there is a network card that can support TCP/IP protocol. The PC can interact with another PC that is running the PWT Network Manager program in the server mode and is connected to the same PC network.

Figure 13:
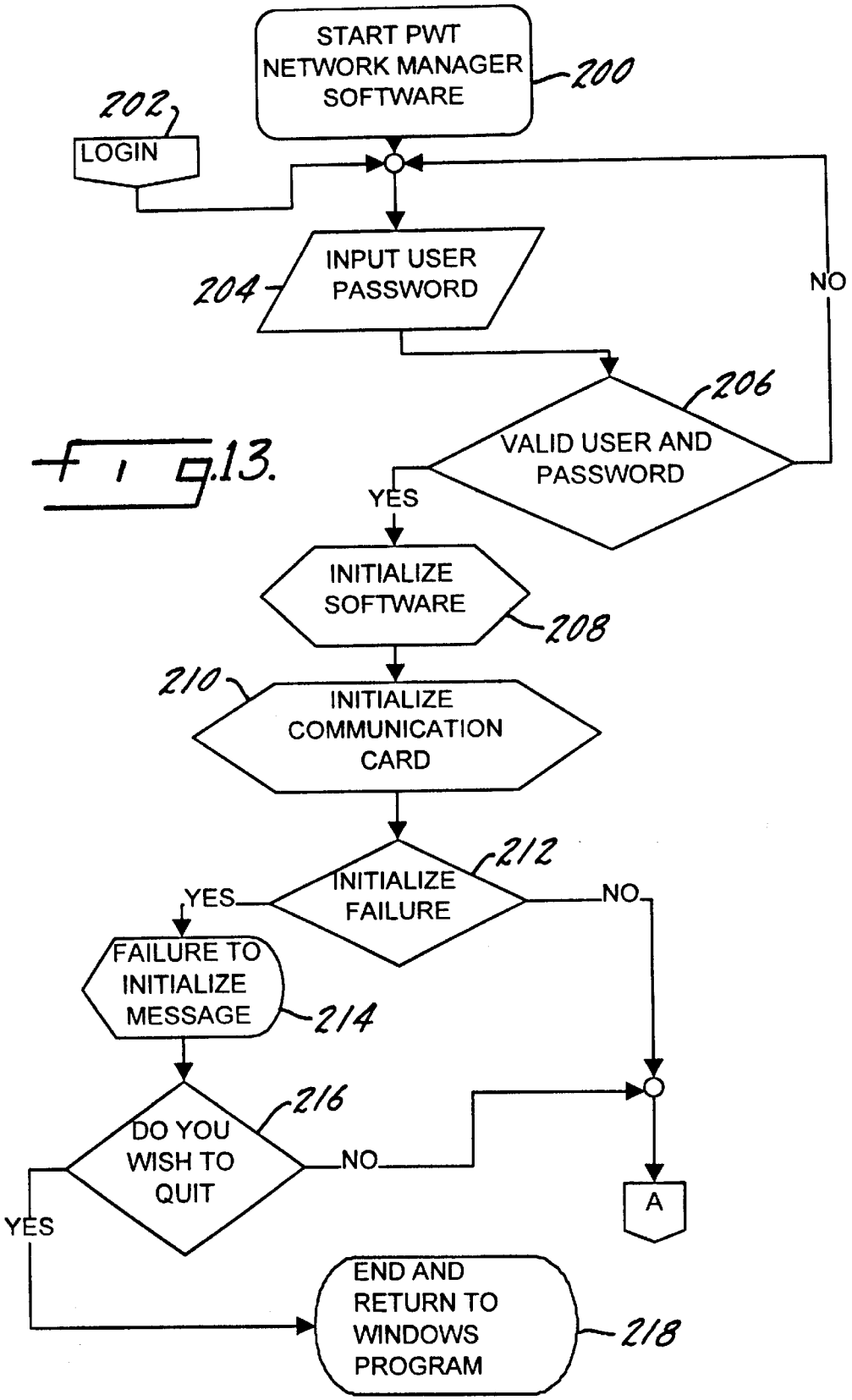
Figure 14:
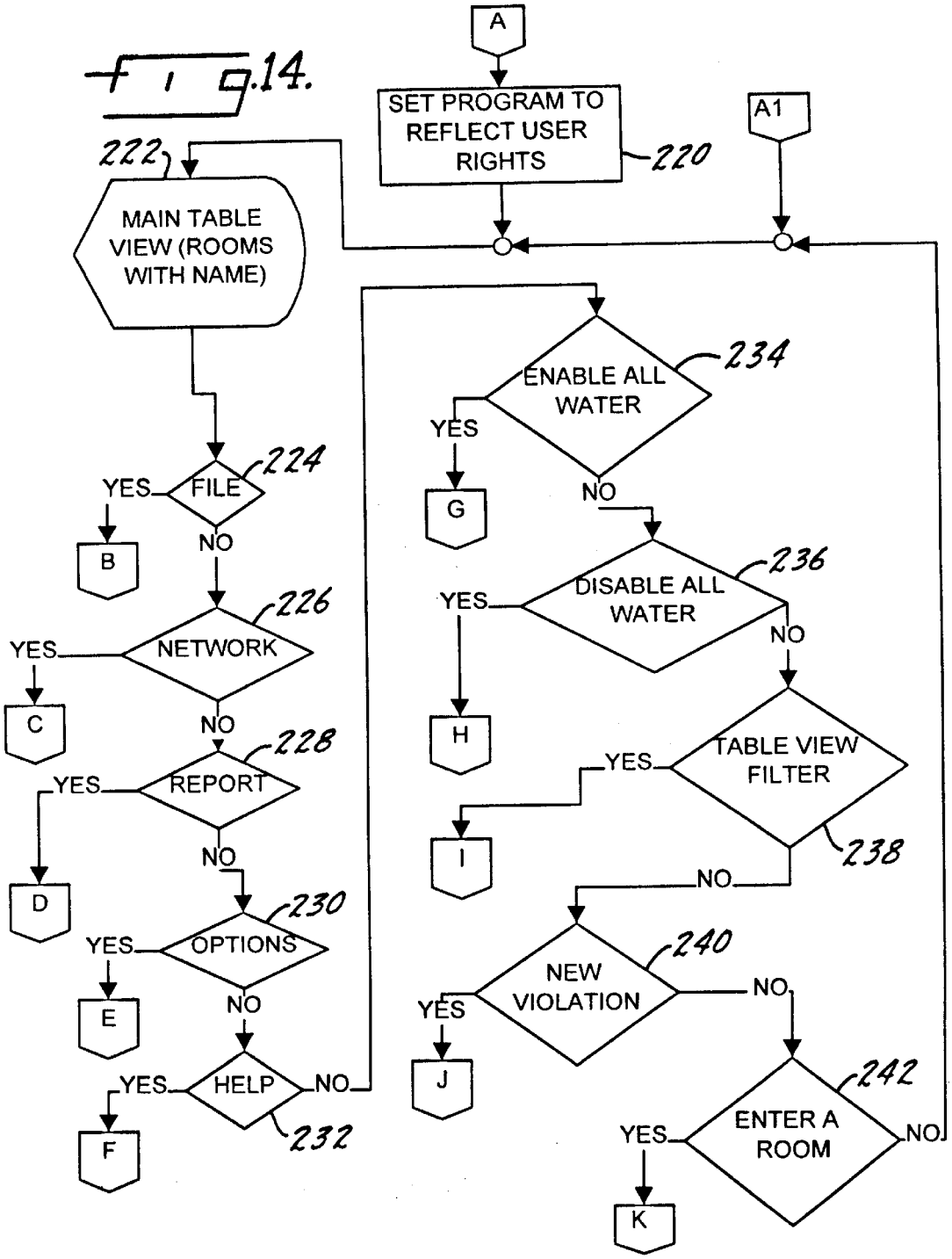

The PWT Network Manager software is described in the flow chart shown in FIGS. 13–26. Looking first at FIG. 13, the software is started at 200 and initially the system administrator should log in to the system 202 and set up any user accounts. Once the system administrator has set up the user accounts, each user can follow the same login procedures to access the system. The privileges associated with each user account will determine which system features are available for that user. The user will be asked for his or her password, 204, and the user's name and password are checked to see if they are valid, 206. Several attempts at a valid user name and password may be permitted. Once a valid user is found the software and communication cards are initialized, 208 and 210.

The following steps are taken during the initialization process: Opening the object server database (a database of graphics that represent fixtures); opening and creating the network; installing the local network variables; attaching to the NSI (the network interface card in the central PC); setting up the NSS (the software that has to do with communications to the NSI); creating a supernode for application devices (a supernode is a node that comprises more than one neuron chip, such as a Smart Sink that has two neuron ID's—one on the 4IO board and one on the display board); reading program templates; and completing the initialization. The network includes a Paradox database and a Lonworks database. Lonworks is a trademark of Echelon Corporation for electronic circuits, integrated circuits, electronic circuit boards, and electrical circuit components for a network which provides identification, sensing, communications or control. Paradox is a trademark of Borland International, Inc. of Scotts Valley, Calif. for computer programs in the field of databases, database application development, report generators and database inquiry.

Initialization is checked for failure, 212. If the initialization fails, a message is displayed 214 and the user is prompted to quit or continue 216. If the user continues, any configuration changes will be saved to the Paradox database but not to the Lonworks database. The Paradox database contains information about the number of buildings, floors, wings and rooms at a particular site. The Lonworks database has an address table that associates neuron ID's of particular 4IO boards (or other Lonmark compliant boards) with particular rooms. This can be useful when configuring a site prior to installation. In this scenario, the user could configure the site without the Lonworks network and then use the import/export feature to copy the Paradox database to disk and then import into the system of the new site during installation. If the user elects to quit, the application will be terminated, 218. If the initialization is successful, the program continues with junction box (the little pentagon) labeled A indicating that FIG. 13 joins with the similarly labeled junction box A on FIG. 14. The software at 220 sets the program up to reflect the current user's rights.

After logging onto the system, the PWT main menu form is displayed, 222. A diagram of the form is shown in FIG. 27. The form includes a menu bar 201 and main section 203 which will be referred to as the table view. The table view contains a visual representation of all of the nodes on the network. To the right of the table view is the table view filter 205. This filter allows the user to view only a subset of the configured site.

The various menu options are available based on the user's privileges. The file menu, network menu, report menu, options menu and help menus will be further described below.

Each room on the table view will be displayed in either white, grey or red. A grey room indicates that no devices have been assigned to that room. A red room indicates that at least one of the devices assigned to that room is in a violation state. A white room indicates that none of the devices associated with that room is in a violation state. Directly under the table view filter is a drop down list of rooms in a violation state. Once a device goes into a violation state, the room associated with that device is added to this list. By selecting a room in this list or by clicking on a white or red room in the main table view, a detail form of that room will be displayed. An example is shown in FIG. 28. By selecting OK from the detail form, the room will be removed from the list until another violation in that room occurs. By selecting cancel from the detail form, the room will remain in the list.

The detail form provides detail information for each of the devices assigned to the room being displayed. Each configured output for each device is displayed, up to eight outputs. The user may click on a device output to select it. A blue box surrounds a currently selected device output.

If the current device output can be activated, a bullet icon will be displayed next to the device output. Clicking on the bullet icon sends an activation notice to the device. Enable and disable push buttons are provided to either enable or disable the currently selected device output. The status for the currently selected device is displayed in the lower left corner of the form.

The user can type room information in the box on the lower right hand of the form. This information is stored for each room and redisplayed each time the user enters the detail form. These notes can be printed by choosing the print notes push button. To print the entire form along with the notes, the print button can be selected. Selecting the parameters button displays the timing parameters form to modify the device output's timing parameters.

The timing parameters include the delay before on time, the on time and, the delay after on time as shown in the table above. Selections can also be made for the lockout time, the cycle count limit and the window time. Once the selections are made in the timing parameters form, they are saved to become the new values for the particular node.

Looking again at FIG. 27, the enable all nodes and disable all nodes buttons 234, 236 at the bottom right corner of the form allow the privileged user the ability to enable or disable all devices in all the rooms currently displayed in the table view. Further details will be described below.

Returning now to FIG. 14, the menu options are shown as file 224, network 226, report 228, options 230 and help 232. If none of these are selected, the program also looks for the enable all nodes button at 234 or the disable all nodes button at 236 and the table view filter 238. The drop down list of the rooms in the violation state is shown at 240, with the option to enter a room at 242.

Figure 15:
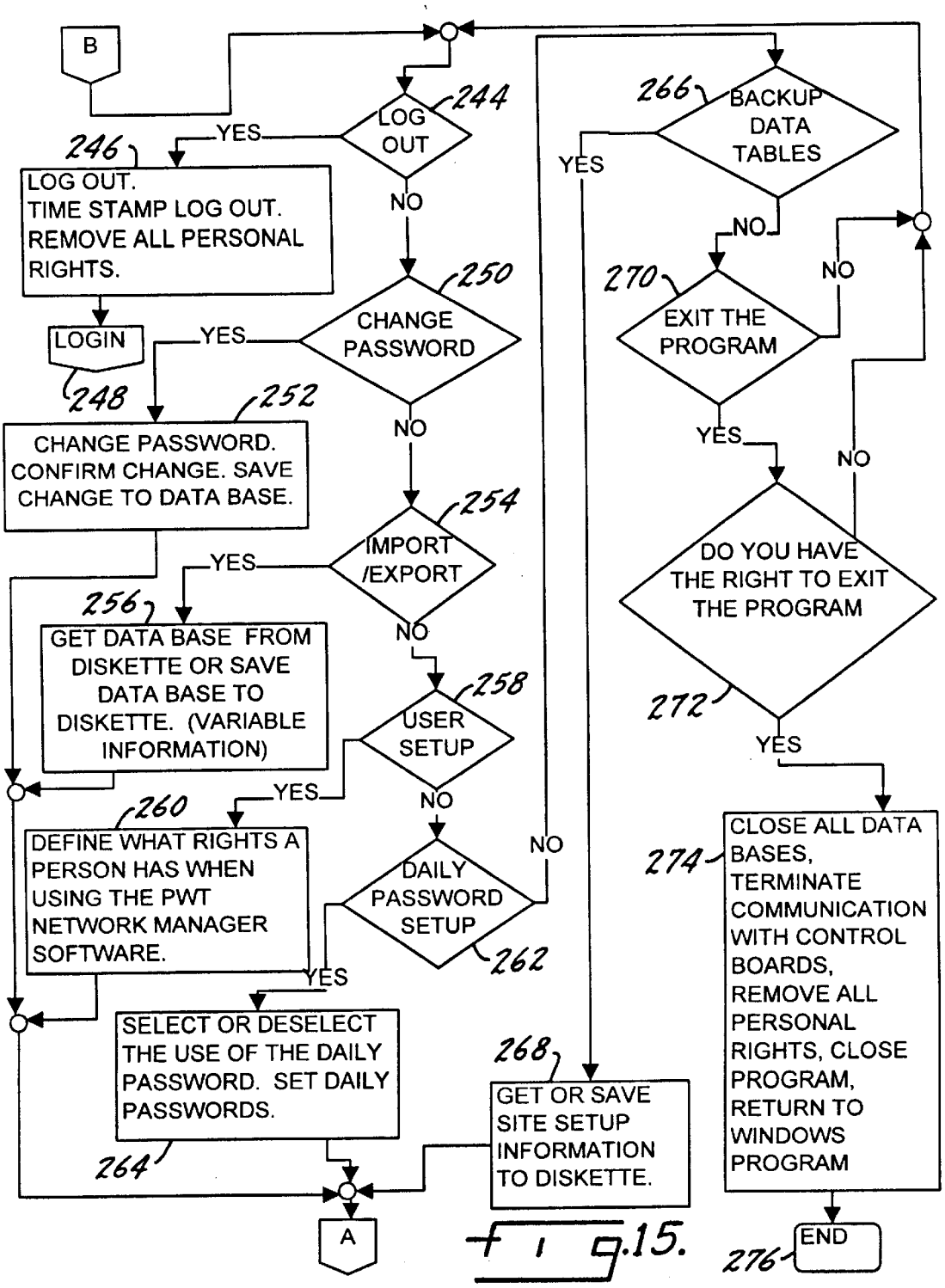

If the file menu is chosen, the program jumps to junction B shown in FIG. 15. The options in this menu include log out 244. This allows the user to log off of the system 246. No user privileges will be allowed until the user logs back into the system by selecting the file log in option 248. The change password option 250 will display a change password form 252 which asks for the current password, the new password and confirmation of the new password and includes a save button to allow the new password to take effect.

The import/export option 254 allows the Paradox tables to be imported into the Lonworks database and vice versa, 256. The import/export form has the capability of deleting all data from both the Paradox tables and the Lonworks database. You can also import data from the Paradox database to the Lonworks database and data can be exported from the Lonworks database to the Paradox database. Both databases will be deleted before new data is imported. The data includes the number of buildings, floors, wings, cells and the details of the fixtures available in each cell.

The user setup option 258 brings up the user setup form 260 and allows definition of the features a user will be allowed to use within the system. It also allows users to be added or deleted or have their privileges modified.

The daily password setup option 262 allows a daily password to be assigned for each day of the year 264. This form also allows the daily password feature to be turned on and off.

The backup data tables option 266 allows the data tables to be copied to or from a diskette or from another directory, 268. This is beneficial in configuring a system off site and later importing the Paradox information into the Lonworks database.

The file menu also provides an exit option 270 which checks to see if the user has the right to exit the program, 272. If the user has that right the program closes all databases, terminates communication with control boards, removes all personal rights from the program, closes the program and returns to the PC's operating system, 274 thus ending the program 276. If the program is not exited it returns to junction A on FIG. 14.

Figure 16:
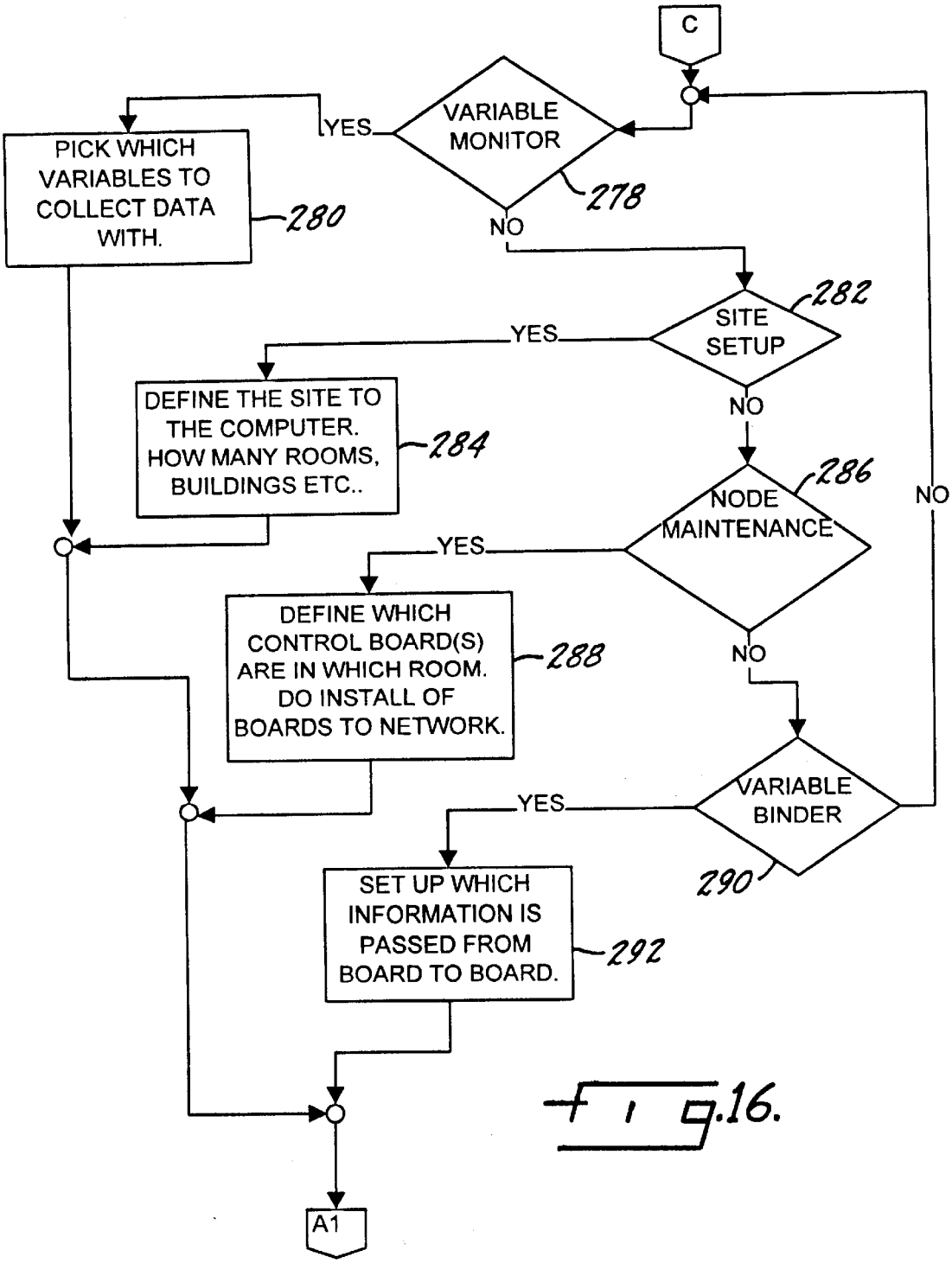

The network options are shown at junction C in FIG. 16. The first option is a variable monitor 278. This allows the user to select and monitor specific network variables for a specific node, 280. In addition, the user can select to log changes in these variables for reporting purposes. The variable monitor puts up a monitor grid which includes columns for a collect data field, the variable to be monitored, the type of variable, the value of the variable, and the direction. Variables added to the monitor grid continue to be monitored until they are deleted from the monitor grid. Only variables that are displayed in the monitor grid with a collect data field of YES are logged in the data log for reporting purposes. Data is only refreshed and logged while the variable monitor form is opened. Data is automatically refreshed based on a timer. The interval rate for the timer can be changed under the options/refresh interval option. Logged data is automatically purged based on the information provided under the options/purge data log and alarm log option. Push buttons are available to add a new variable to monitor in the monitor grid. There are also buttons to delete a network variable from the monitor grid and to modify the variable to change the value of the network variable. A modification button is enabled only for input type variables. A refresh button initiates the refresh of the network variables in the monitor grid. In other words, this gets the network variable value for each variable in the monitor grid. The variable monitor form can be closed at which time variables can no longer be refreshed or logged.

The site setup option 282 allows the configuration of the number of buildings, floors, wings and rooms within the system, 284. The site setup form includes fields for the site name, the number of buildings in the site, the building number of the building currently being configured, a building name associated with the selected building number, the number of floors for the building identified by the building name and number, the floor number of the floor currently being configured, the floor name, the number of wings, the wing number of the wing currently being configured, and the wing name associated with the selected wing number. There are also defaults that indicate whether there is more than one building, floor, or wing in the system being generated. The site setup form also includes fields for individual rooms. A room can be added by typing a room name. A range of rooms can be added by selecting a start and stop point of the range, the name prefix and pressing the add button. Rooms can be removed by selecting a room from the list box and pressing the delete key. A range of rooms can be deleted by selecting the start and end range and pressing the delete button next to the named prefix. The site setup form can be cleared to start fresh with data entry. It can be restored to read and display the site configuration last saved to the Paradox table. A save button is supplied as is a cancel button.

The next option on the network menu is node maintenance 286 which assigns specific nodes or control boards to a room 288. Devices can be assigned to a room without providing a neuron ID prior to installation. At installation time the find nodes feature can be used to obtain the neuron IDs of the devices on the network and then drop and drag these neuron ID onto the appropriate device. Thus the site setup defines the buildings, floors, wings and rooms in a site. And the node maintenance assigns a specific network card, or in this case a 4IO card, to the defined rooms. The node maintenance form includes a find button that waits for the service switch SW2 in the 4IO board to be pressed. When that switch is pressed the 4IO card sends its unique neuron ID number and tells the PWT software which ID number is in which room. Once a device is commissioned (assigned a neuron ID) it can be reset, tested or taken on or off line.

The next option in the network menu is the variable binder 290. This allows binding of specific network variables from one node to another. That is, it identifies which information is going to be passed from one board to the next, 292. A variable binding form allows the user to add a hub node and network variable to the connection list. It can also delete a hub node and network variable from the connection list. Connection properties allow each connection to be configured separately after selecting the hub node and network variable from the connection list and selecting a binding filter and network variable to bind. A connect button is used to create a binding between these two nodes and network variables. A disconnect button is provided to remove the binding between two nodes and variables. The network menu option returns to junction A1 on FIG. 14.

Figure 17:
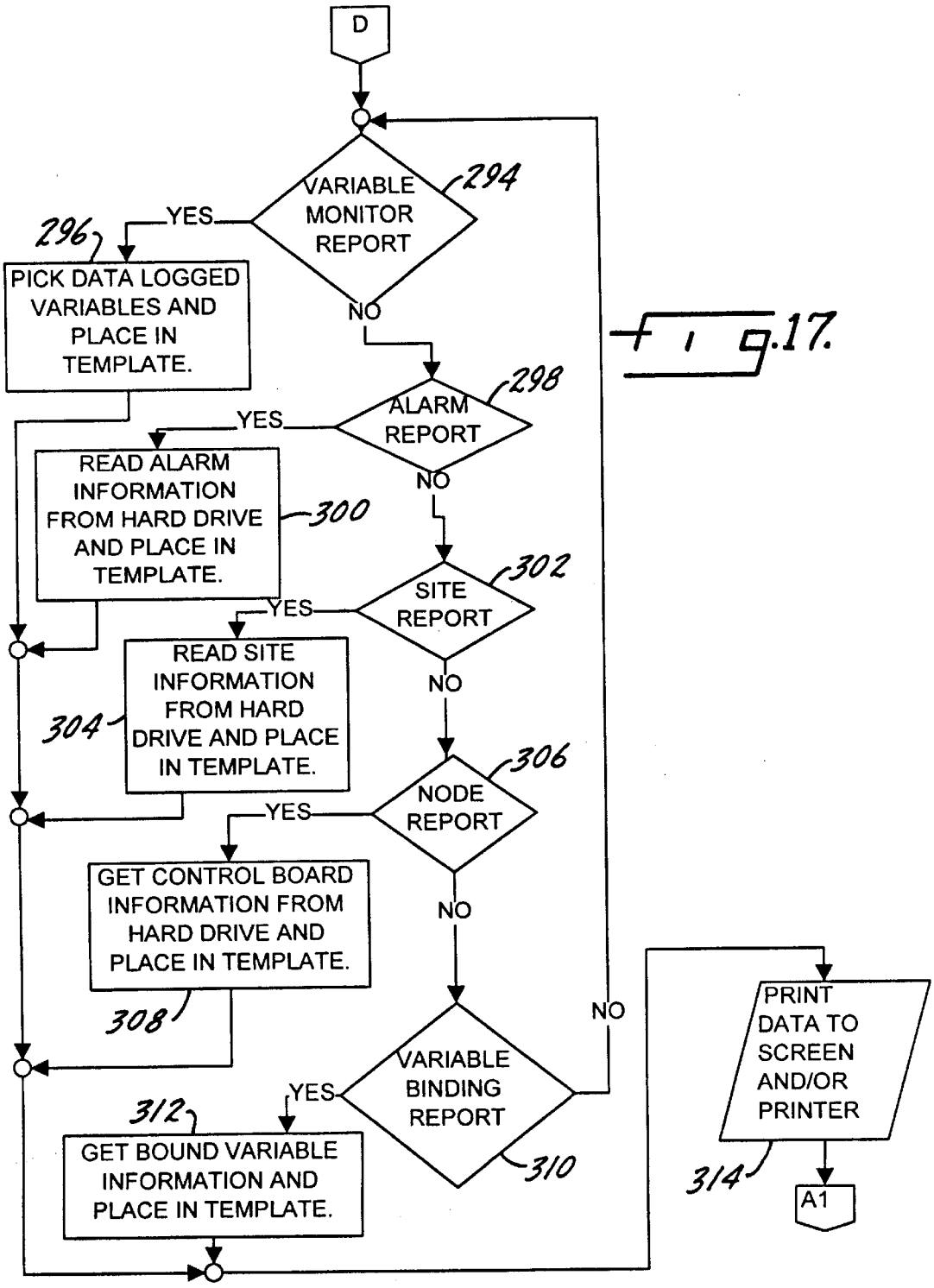

The report option is shown at junction D on FIG. 17. The variable monitor report 294 will display a form that allows the user to select which monitored/logged network variables to generate a report from. The desired reporting variable is dropped in a column. If desired a new label for the column and report header may be typed in. The user selects print or view to generate a Reportsmith report containing the selected variables 296.

The alarm report 298 presents all alarms by the system 300. The report is sorted by computer date and node.

The site report 302 describes the site layout 304. The node report 306 describes the node layout 308. The variable binding report 310 describes the variable bindings between nodes 312. Any of the selected reports are printed to the screen and/or hard copy at 314. The PWT manager then returns to junction A1 on FIG. 14.

Figure 18:
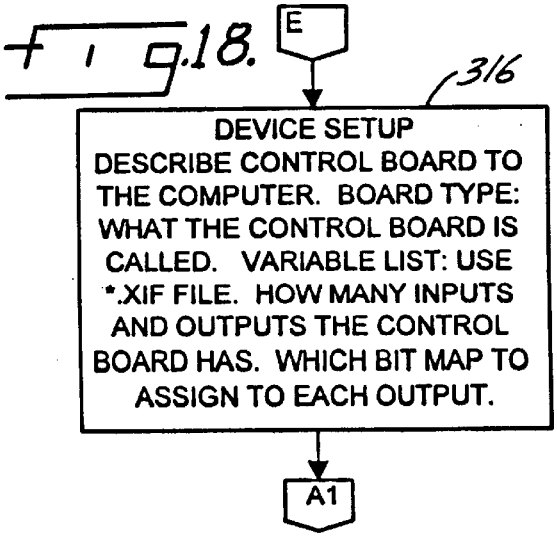

Selection of the options menu 230 causes the network manager to branch to junction E in FIG. 18. The options menu will display a device setup form 316 which will allow a device to be added, described and associated with a Lonworks configuration file. It will describe the board type, a variable list, how many inputs and outputs the control board has and which bit map to assign to each output. The option menu returns to junction A1 in FIG. 14. The device setup form allows a user to modify, add or delete a device type. To delete an existing device type, select the row of the device to be deleted and press the delete key. To add a new device type, simply enter the appropriate information in the blank row at the bottom of the table. For each device type a unique ID is created and a unique name should be given. This name will be used for selecting the device type when creating a new node. Specify the program template file associated with this device type. Next identify the device type as a supernode (parent), child of a supernode (child of device ID), or normal. Under the IO count column, indicate how many output devices are associated with this node (up to four). Then identify each output type (toilet, shower, sink, towel, soap, hot faucet of sink, cold faucet of sink). If the program variables should be bound to the PC, specify YES in the bind column, otherwise specify NO.

Figure 19:
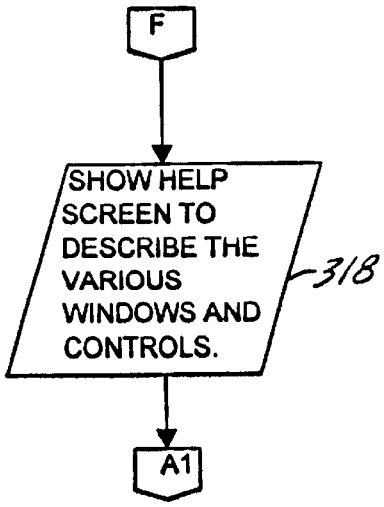

The help menu option 232 branches to junction box F in FIG. 19. This will show help screens to describe the various windows and controls, 318. The options on the help menu will include contents, how to use help and a menu option which will display a form indicating the version of the PWT Network Manager software. The help options returns to junction A1 in FIG. 14.

Figure 20:
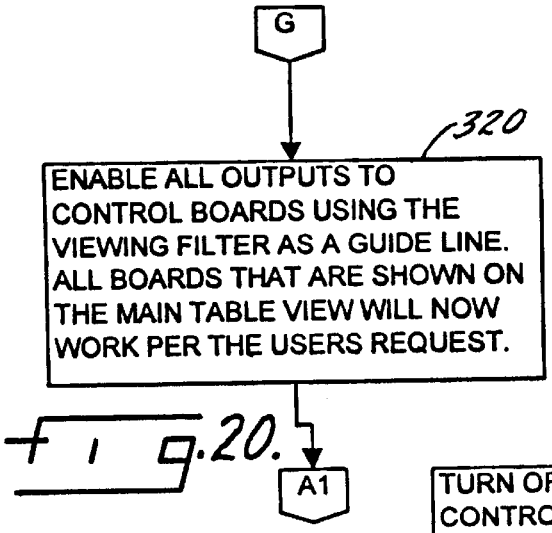

The enable all water nodes push button 234 branches to junction box G, FIG. 20. This will ask the user if the user really wants to enable all outputs of the control boards in each of the rooms displayed in the table view, 320. The user answers yes or no and the program returns to junction A1.

Figure 21:
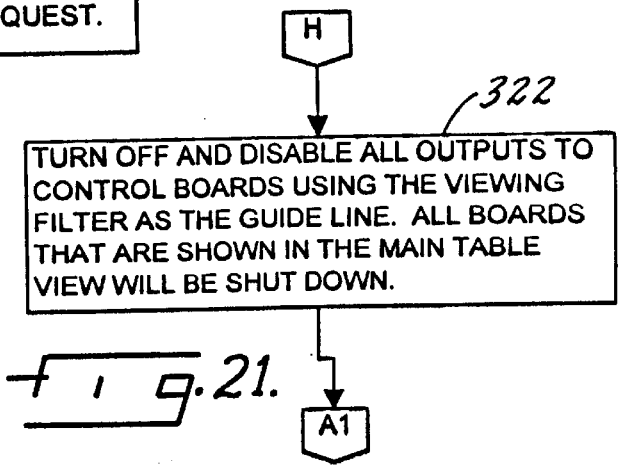

A similar question is posed at junction H, FIG. 21 for the disable all water nodes option. This option at 322 will shut down all the boards shown on the main table view. Again, program control returns to junction A1.

Figure 22:
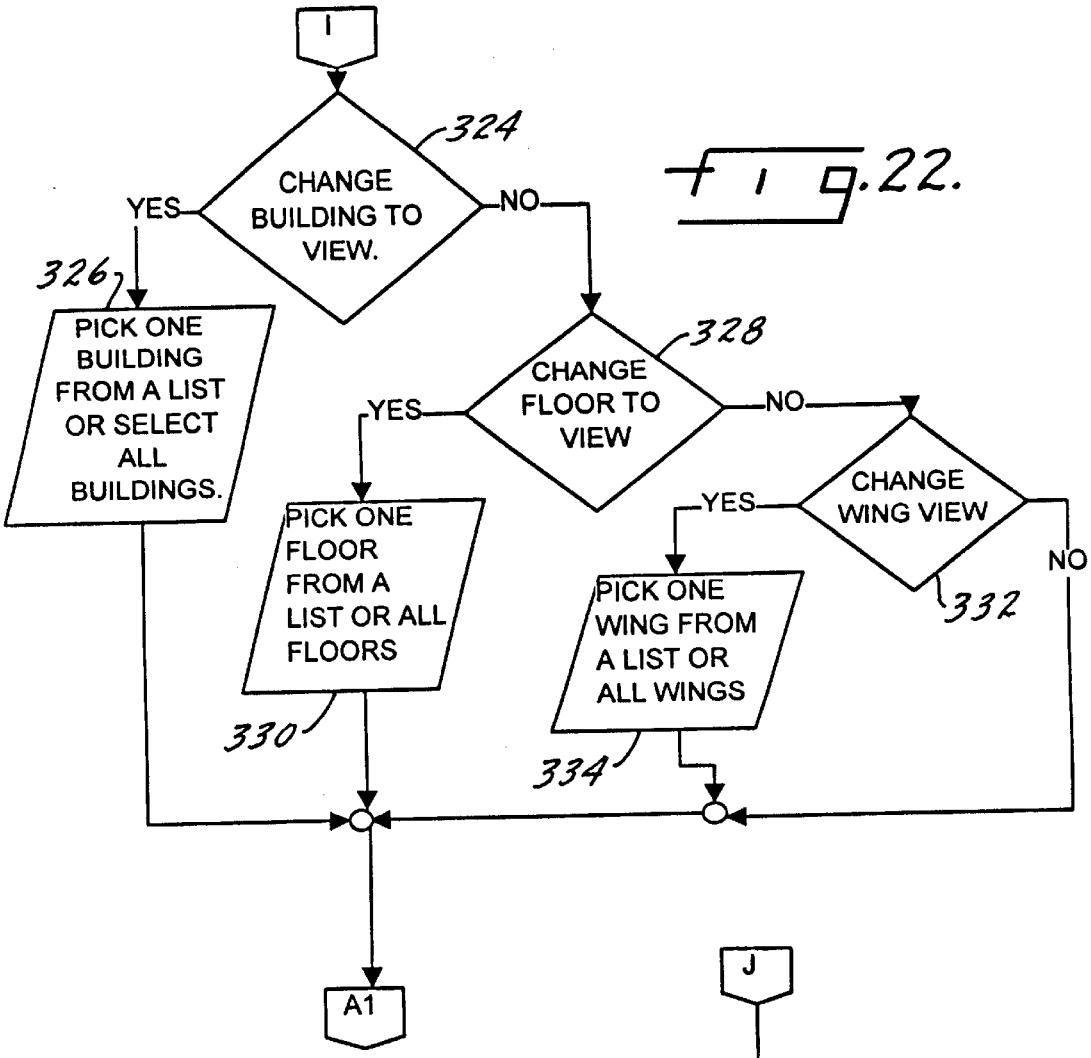

The table view filter 238 branches control to junction I, in FIG. 22. The table view filter allows the user to select a subset of the configured site. The filter is saved by each computer and will be reinitialized each time the application is started. The table view filter can only be changed by users with the privilege to changing the building, floor, wing and/or room filters. The filters include the option to change the building 324 by picking one building from a list or selecting all buildings, 326. The user can also select a floor 328 by picking one floor or all of them, 330. Within each floor, a wing can be chosen 332 by picking one wing or all wings from a list, 334. Control returns to junction A1 on FIG. 14.

Figure 23:
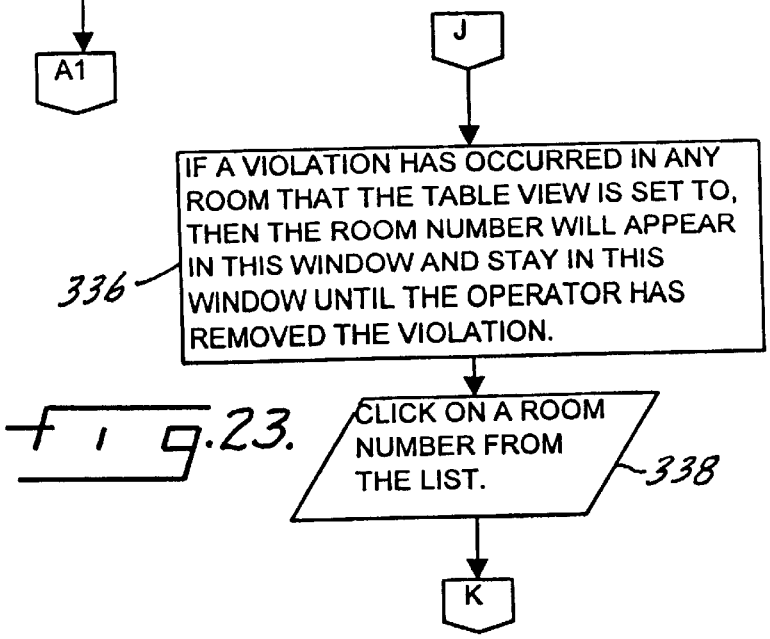

The new violation table 240 branches to junction box J, seen in FIG. 23. If a violation has occurred in any of the rooms displayed on the table view filter, that room number will appear in the main screen and stay in the window until the operator has removed the violation, 336. From this listing, a user can enter a room to view its detail, 338. The detail of a room can be accessed either from step 338 of FIG. 23 or from the enter a room selection 242 in the main table view. Both of these paths connect to junction box K on FIG. 24. The steps shown in FIG. 24 basically create the output shown in the detail form of FIG. 28. At step 340 the status of the control boards via bit maps and status strings is displayed. At 342, a blue box is placed around the output to manipulate. Options are available at 344 and 346 to disable or enable all boards assigned to that room, at 348 and 350. Option 352 allows the user to disable just the output of the device that is surrounded by the blue box 354.

The program continues at junction K1 on FIG. 25. At 356 the user can enable the output surrounded by the blue box, 358. A push button 360 is provided to change the parameters for the output the blue box is around. As shown at 362, the delay before activation, activation time delay, delay after activation, lockout time, target limit and lockout length of time are all available to be altered at this point. A print button 364 permits printing of all information 366. A print notes button 368 prints only a memo field.

Figure 26:
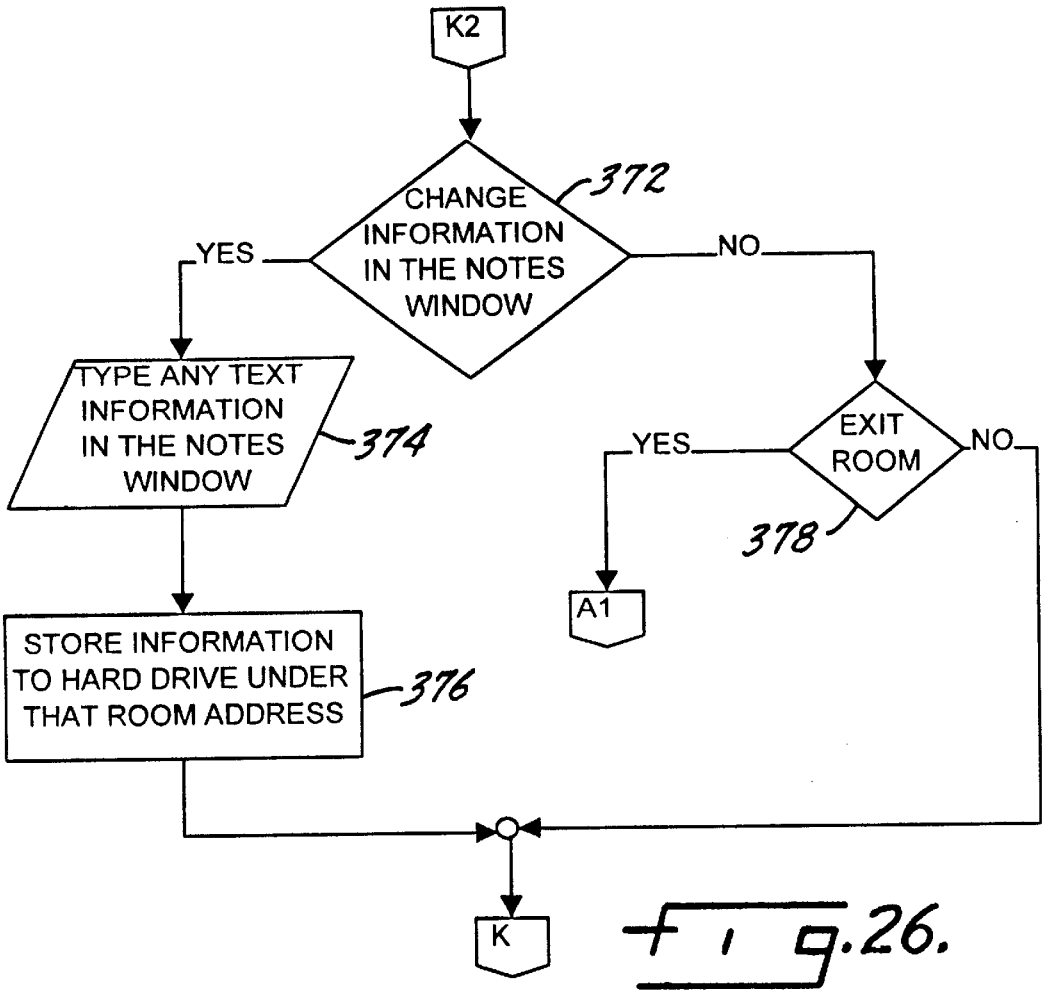

The program continues at junction K2 on FIG. 26. The detail form permits a user to change information in the notes or memo field 372. Any text information can be typed into the notes window 374. Information is stored to the databases on the hard drive at 376. The user is also given the option at 378 to return to the main screen at junction A1 on FIG. 14 or go back to junction K in FIG. 24.

While a preferred form of the invention has been shown and described, it will be realized that alterations and modifications may be made thereto without departing from the scope of the following claims.

We claim:

1. A method of assuring proper hand washing procedure utilizing a faucet, soap dispenser, a dryer means for drying hands, and separate sensors for detecting hands in proximity to each of the faucet, soap dispenser and dryer means, comprising the steps of:

a) opening the faucet to discharge water while the faucet sensor is triggered during a wetting time interval;

b) thereafter dispensing soap when the soap dispenser sensor is triggered;

c) thereafter disabling the faucet to prevent discharge of water during a scrub time interval, while maintaining operability of the soap dispenser during the scrub time interval; and d) subsequent to the scrub time interval enabling the faucet such that the faucet can discharge water while the faucet sensor is triggered during a rinse time interval.

2. The method of claim 1 further comprising the step of restarting the scrub interval if the soap dispenser is triggered during the scrub interval.

3. The method of claim 1 further comprising the step of activating the dryer means after the rinse interval.

4. The method of claim 1 further comprising the step of maintaining operability of the dryer means at all times.

5. The method of claim 1 further comprising the steps of providing a message board and displaying a different message for each of steps a)–d).

6. The method of claim 1 further comprising the step of providing a verification output when a proper hand washing procedure has occurred.

7. The method of claim 6 further comprising the step of maintaining operability of the dryer means at all times but activation of the dryer means prior to completion of the scrub time interval will prevent provision of said verification output.

8. The method of claim 1 further comprising the step of indicating the end of the scrub time interval by briefly turning the faucet on and off at least once.

9. The method of claim 1 further comprising the step of logging the number of times said faucet, said soap dispenser and said dryer means have been used.

10. A hand washing apparatus, comprising a faucet for discharging water, a soap dispenser for dispensing soap, a dryer means for drying hands, a first sensor for detecting hands under the faucet, a second sensor for detecting hands under said soap dispenser, a third sensor for detecting hands proximate to the dryer means, a programmable computer controller operatively connected to said faucet, soap dispenser, dryer means, and said first, second and third sensors, and a mode selection switch separate from said sensors for selecting a smart mode or a random mode of operation such that when the smart mode is selected the computer causes the apparatus to operate in a sequenced hand washing cycle while in the random mode the faucet, soap dispenser and dryer means are each under the control of their respective sensors, independently of one another.

11. The apparatus of claim 10 further comprising a message board operatively connected to said computer.

12. The apparatus of claim 10 wherein said dryer means is a paper towel dispenser.

13. The apparatus of claim 10 further comprising an override switch for turning the faucet on regardless of the status of the computer.

14. In a hand washing apparatus comprising a faucet for discharging water, a soap dispenser for dispensing soap to a user hands, a dryer means for drying hands, a first sensor for detecting hands under the faucet, a second sensor for detecting hands under said soap dispenser, a third sensor for detecting hands proximate to the dryer means, and a programmable computer controller operatively connected to said faucet, soap dispenser, dryer means, and said first, second and third sensors, a method of assuring a proper hand washing sequence comprising the steps of:

discharging water from the faucet to wet hands during a user-determined wetting time interval;

dispensing soap to a user hands when said soap dispenser sensor is triggered;

disabling the faucet sensor during a predetermined hand scrub time interval;

thereafter discharging water from the faucet during a user-determined hand rinse time interval; and operating said hand dryer means at the end of the rinse time interval.

15. The method of claim 14 further comprising the steps of while maintaining operability of the soap dispenser during the scrub time interval and restarting the scrub time interval if the soap dispenser is triggered during the scrub time interval.

16. The method of claim 14 further comprising the step of maintaining operability of the dryer means at all times.

17. The method of claim 14 further comprising the steps of providing a message board and displaying a different message for each of the steps.

18. The method of claim 14 further comprising the step of providing a verification output when a proper hand washing sequence has occurred.

19. The method of claim 18 further comprising the step of maintaining operability of the dryer means at all times but activation of the dryer means prior to completion of the scrub time interval will prevent provision of said verification output.

20. The method of claim 14 further comprising the step of indicating the end of the scrub time interval by briefly turning the faucet hon and off at least once.

* * * * *